US009555301B2

(12) United States Patent
Rieman

(10) Patent No.: US 9,555,301 B2
(45) Date of Patent: Jan. 31, 2017

(54) MODULAR BEER PONG TABLE CONSTRUCTED OF EASILY INTERCHANGEABLE MODULES

(71) Applicant: Austen Roberto Rieman, Tustin, CA (US)

(72) Inventor: Austen Roberto Rieman, Tustin, CA (US)

( * ) Notice: Subject to any disclaimer, the term of this patent is extended or adjusted under 35 U.S.C. 154(b) by 0 days.

(21) Appl. No.: 14/198,578

(22) Filed: Mar. 5, 2014

(65) Prior Publication Data

US 2014/0252718 A1 Sep. 11, 2014

Related U.S. Application Data

(60) Provisional application No. 61/773,101, filed on Mar. 5, 2013.

(51) Int. Cl.

| | |
|---|---|
| ***A63B 67/00*** | (2006.01) |
| ***A63F 7/00*** | (2006.01) |
| *A63B 71/00* | (2006.01) |
| *A63B 71/02* | (2006.01) |
| *A63B 9/00* | (2006.01) |
| *A63H 33/08* | (2006.01) |

(Continued)

(52) U.S. Cl.

CPC ..... *A63B 67/007* (2013.01); *A63B 67/002* (2013.01); *A63F 7/0017* (2013.01); *A63B 71/0036* (2013.01); *A63B 71/023* (2013.01); *A63B 2009/006* (2013.01); *A63B 2208/03* (2013.01); *A63B 2208/12* (2013.01); *A63B 2210/50* (2013.01); *A63B 2225/10* (2013.01); *A63B 2225/60* (2013.01); *A63B 2225/605* (2013.01); *A63F 2007/3659* (2013.01); *A63F 2007/3662* (2013.01); *A63F 2009/0058* (2013.01); *A63F 2250/024* (2013.01); *A63H 33/086* (2013.01)

(58) Field of Classification Search

CPC ..... A63B 63/08; A63B 67/00; E04B 5/00; B32B 3/04; B63C 9/08; A63F 3/00

USPC ..... 52/309.1; 273/242, 348, 400; 296/203.1; 428/68; 441/88; 206/736

See application file for complete search history.

(56) References Cited

U.S. PATENT DOCUMENTS 4,765,252 A * 8/1988 Shuert ..... B65D 15/22 108/55.1

5,297,836 A * 3/1994 Parry-Williams .... B62D 27/026 296/187.02

(Continued)

*Primary Examiner* — Gene Kim
*Assistant Examiner* — Christopher Glenn

(57) ABSTRACT

A modular beer pong table comprising a plurality of planar members. Each planar member having the ability to connect to any other planar member indiscriminately by a unique mechanism that employs an alternating pattern of protrusions which can mate with any other similar set of alternating protrusions. The mating protrusions providing for a strong joint and easy assembly. The planar members along with cap-like members combine to form a briefcase-like assembly for easy transportability and storability. The briefcase-like assembly further being able to retain two specialized stands which can be used to elevate the modular beer pong table during use. The modular beer pong table having the ability to float on water. Additional planar members of a modular nature that facilitate multiple concurrent beer pong game sessions. One embodiment employing the unique method of connecting modules for use in a toy construction set.

1 Claim, 40 Drawing Sheets

(51) Int. Cl.
*A63F 7/36* (2006.01)
*A63F 9/00* (2006.01)

(56) References Cited

U.S. PATENT DOCUMENTS

| | | | | |
|---|---|---|---|---|
| 7,237,776 | B1 * | 7/2007 | Ngoto | A63F 3/02 273/242 |
| 7,325,807 | B1 * | 2/2008 | Eason | A63F 7/0005 273/342 |
| 8,176,745 | B1 * | 5/2012 | Korza | A63B 67/066 62/258 |
| 8,651,492 | B1 * | 2/2014 | Cappuccio | A63B 67/002 273/317 |
| 8,905,406 | B2 * | 12/2014 | Brown | A63B 63/08 273/342 |
| 2007/0223993 | A1 * | 9/2007 | Peterson, Jr. | E01C 5/005 403/364 |
| 2011/0076437 | A1 * | 3/2011 | McKee | A63C 17/017 428/68 |
| 2011/0120037 | A1 * | 5/2011 | Barlow | B44C 1/28 52/309.1 |
| 2011/0269357 | A1 * | 11/2011 | Carroll | A41D 13/0125 441/88 |

* cited by examiner

Fig. 11
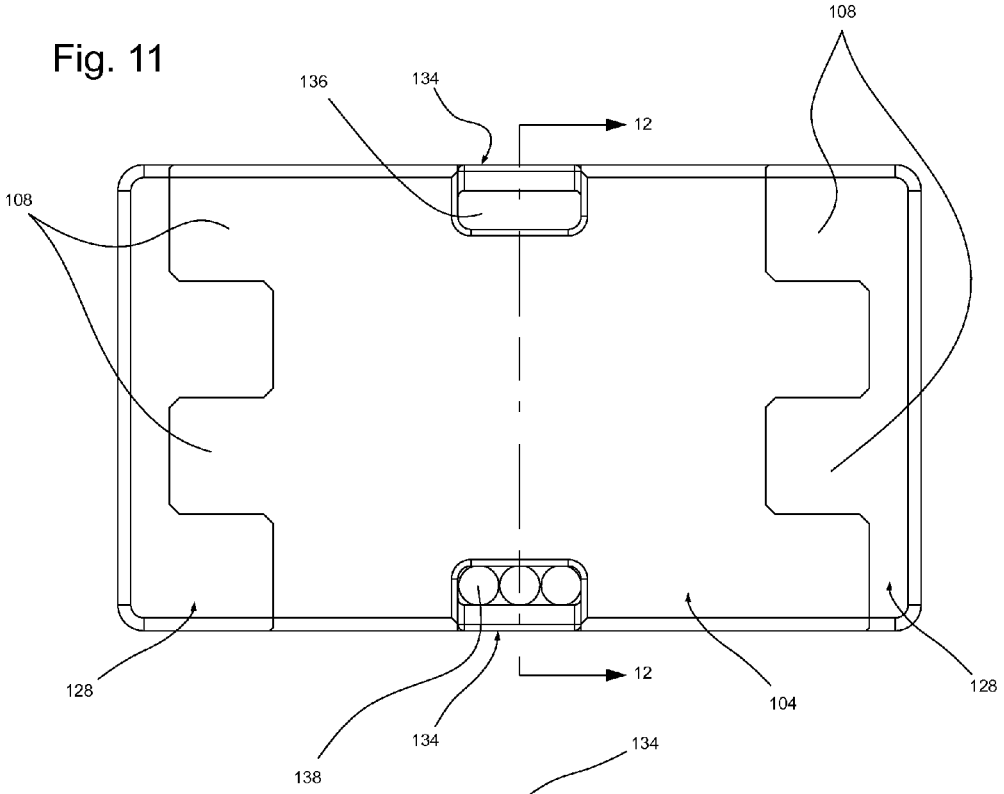
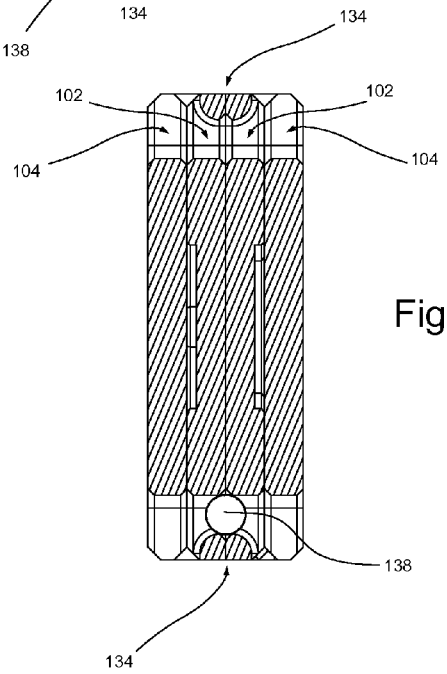
Fig. 12

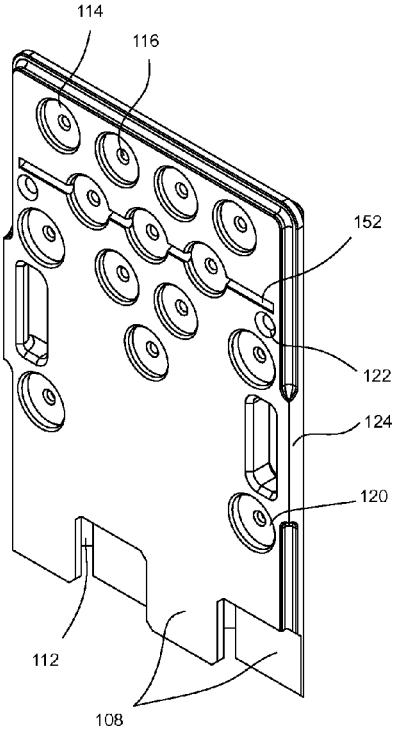
Fig. 25
Fig. 26
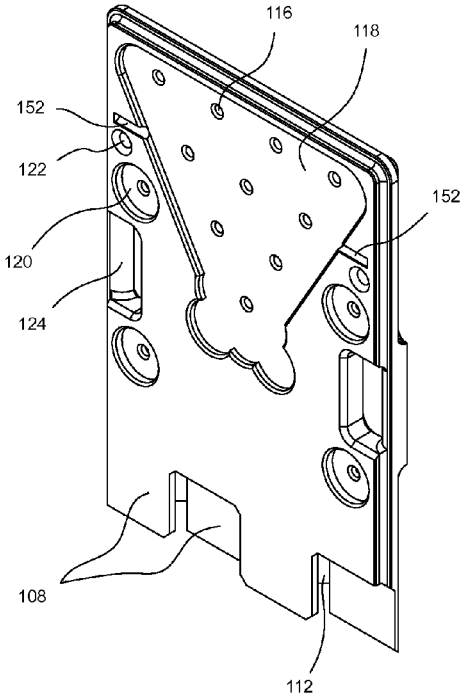

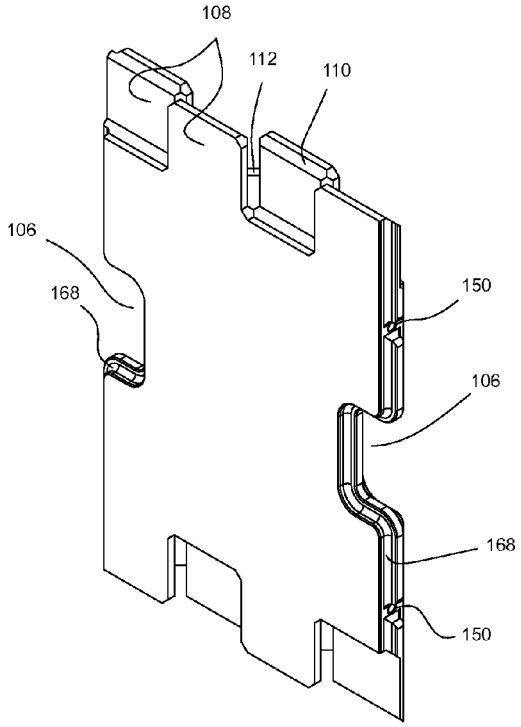
Fig. 27
Fig. 28
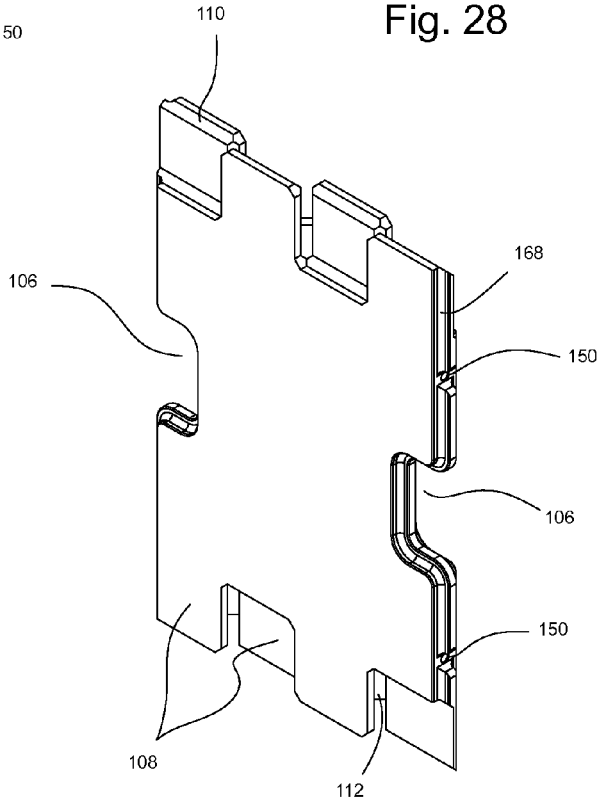

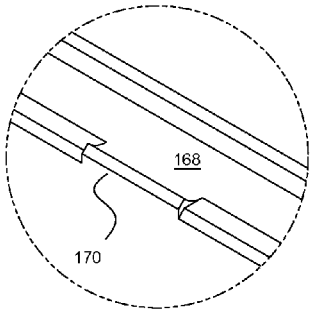
Fig. 30
Fig. 29
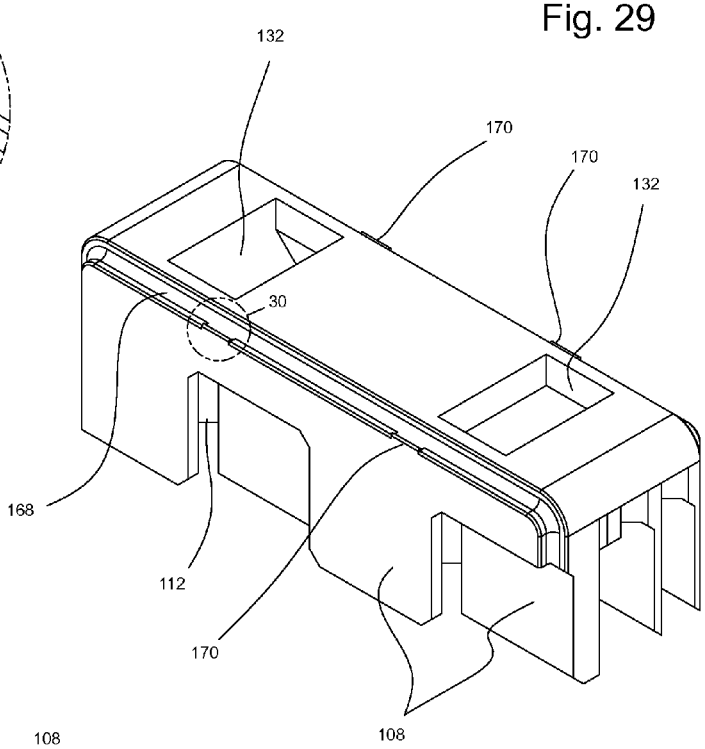
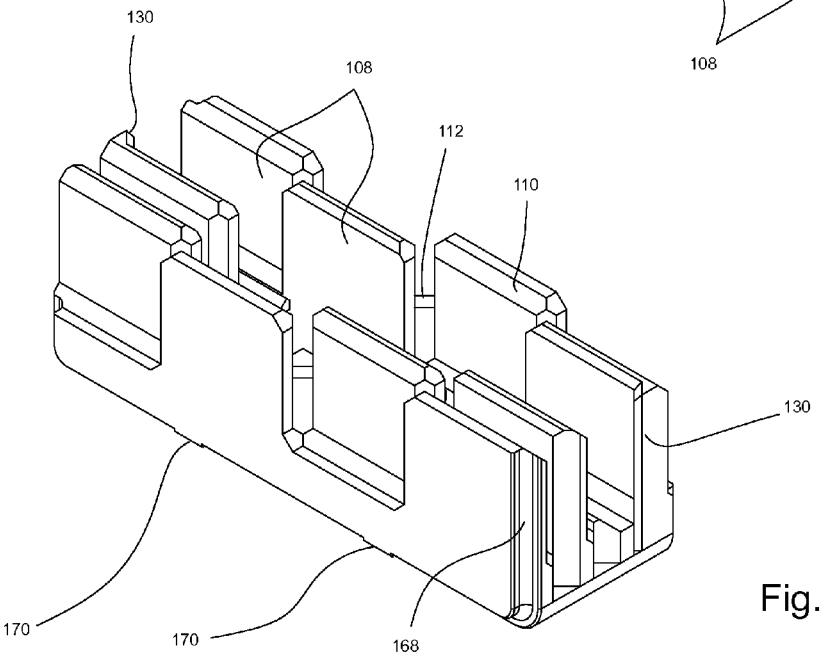
Fig. 31

Fig. 48
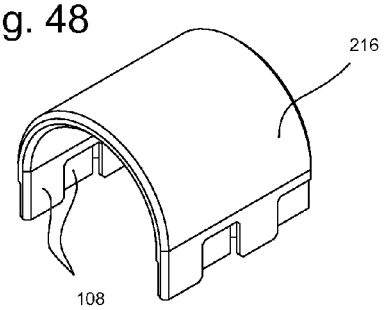
Fig. 49
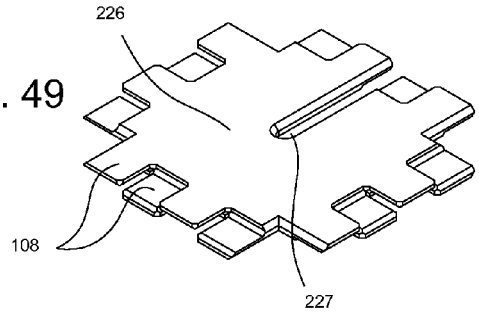
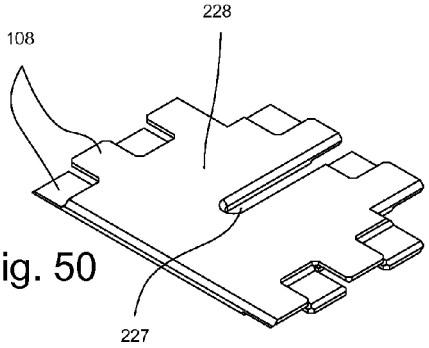
Fig. 50
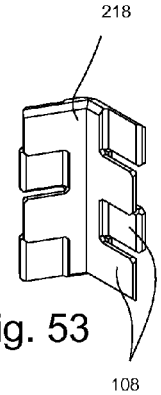
Fig. 53
Fig. 54
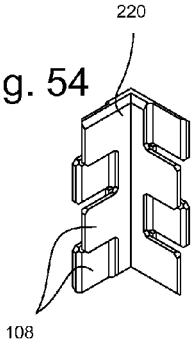
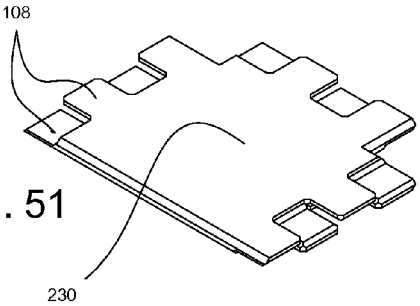
Fig. 51
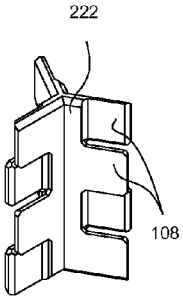
Fig. 55
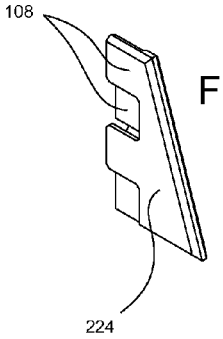
Fig. 56
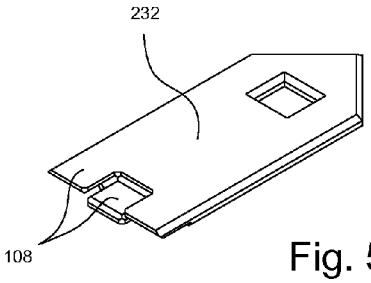
Fig. 52

Fig. 66
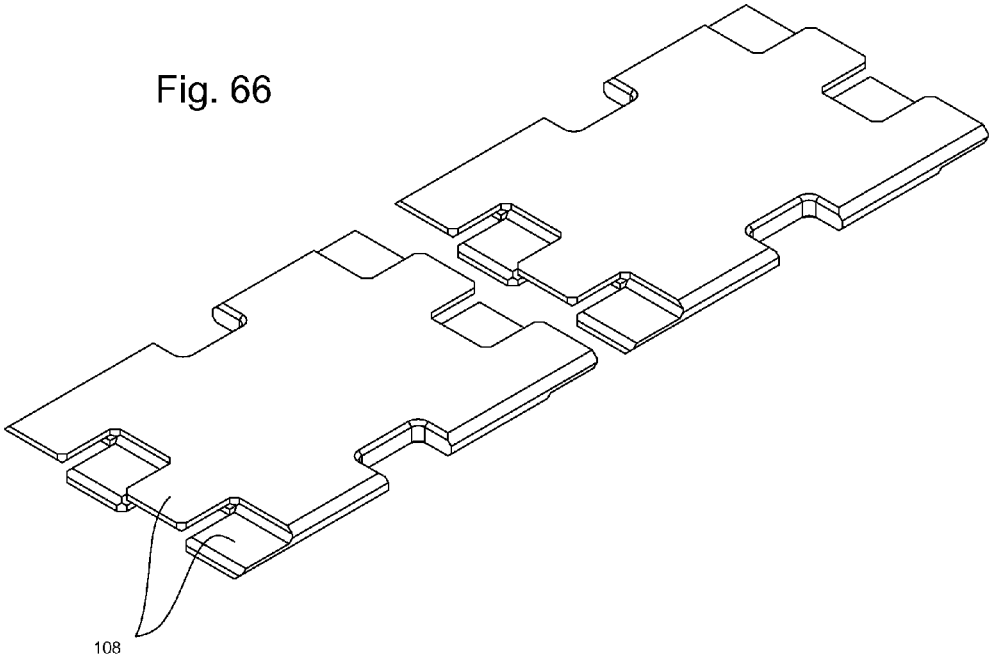
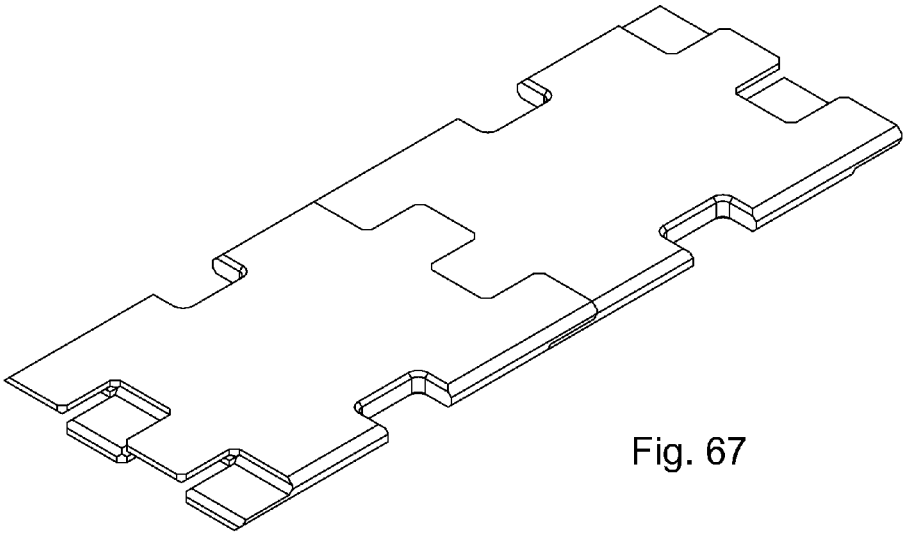
Fig. 67

MODULAR BEER PONG TABLE CONSTRUCTED OF EASILY INTERCHANGEABLE MODULES

CROSS-REFERENCE TO RELATED APPLICATIONS

This application claims the benefit of U.S. Provisional Patent Application Ser. No. 61/773,101, filed Mar. 5, 2013, by the present inventor, which the entire specification of which is incorporated herein by reference.

BACKGROUND OF THE INVENTION

Beer Pong is a table top game that is a popular pastime for college students, and is quickly spreading beyond the college campus. Arranging a plurality of cups at either end of a table in a triangular formation, players take turns attempting to toss a ping pong ball into any of the cups on the side of the table opposite to them. Cups are taken out of play once a ball is sunk, and the player or team that is first to eliminate the opponents cups wins the game. Beer pong can and is played on a variety of table tops or surfaces such as ping pong tables, dining tables, floors, and counters. Several products even allow beer pong to be played in the pool. Portable Versions have been designed with tailgating and camping in mind.

Beer pong tables that have been designed for the pool have taken many approaches from inflatable rafts with cup holders to flat foam tables with cup holder cutouts. The inflatable tables suffer from numerous shortcoming. First, the cup holders do not allow for the cups to be level and touching at the rims. This is a critical flaw as poor cup alignment causes chaotic deflections of a players shot, often making for a frustrating experience. Second, due to their inflatable nature, these tables are large and clumsy, often rising form the water about half a foot, requiring players to stand in shallow water so that much of their body is out of the water and potentially exposed to uncomfortable breezes. Also, the large thickness of the table will cause it to easily be shifted by a light breeze. Third, the table needs to be inflated for use and deflated for transporting and storage, requiring that the user have a manual or electrical air pump. Blowing these tables up by mouth is a time-consuming and frustrating affair. Once deflated, the product is disorderly, and, as they don't have handles, are difficult to carry. Fourth, inflatable tables are restricted to their original size, usually six feet, two feet under regulation size tables. Player have different preferences when it comes to the length of the table, and those preferences usually depend on the skill level of the player. Sixth, the uneven surface of inflatable tables makes bounce shots a near impossibility. Fifth, inflatable tables are highly susceptible to ruptures which render the product useless unless the hole is patchable.

Foam beer pong tables also suffer from numerous shortcomings. Beer pong tables made of foam are usually six feet or longer. Due to this, they are very difficult to transport and store, and, therefore, also making them very costly to ship. Unlike inflatable tables, there is no way to reduce their volume, and folding the tables in half often results in damage to the product and does little in the way of making them more orderly. The length of these tables also makes them costly to manufacture as low cost manufacturing techniques such as steam-chest molding are not employable. Also, like their inflatable counterparts, current foam tables are restricted to their original size.

Beer Pong tables designed for land use also have their share of shortcomings. Many portable versions have folding partitions, and, due to the mechanisms involved, require high labor costs. These tables are often very heavy, usually around thirty pounds, with their handles being of little consolation. The narrow legs of these tables make beach use difficult, and their heavy nature prevents them from being used in the pool.

DRAWINGS

FIG. 11 is an elevational view of the briefcase-like assembly;

FIG. 12 is a cross-sectional view of the briefcase-like assembly as taken through line 12-12 of FIG. 11;

FIG. 25 is an enlarged perspective view of the front of an end board planar member from the modular beer pong table designed for use with a specialized stand;

FIG. 26 is an enlarged perspective view of the back of the end board planar member from the modular beer pong table designed for use with a specialized stand;

FIG. 27 is an enlarged perspective view of the front of a middle board planar member from the modular beer pong table designed for use with a specialized stand;

FIG. 28 is an enlarged perspective view of the back of the middle board planar member from the modular beer pong table designed for use with a specialized stand;

FIG. 29 is an enlarged perspective view of the top of a cap-like member from a briefcase-like assembly designed for use with a specialized stand;

FIG. 30 is a detailed perspective view of a portion of the cap-like member from the briefcase-like assembly designed for use with specialized stand as taken from a sectioned area labeled 30 in FIG. 29;

FIG. 31 is an enlarged perspective view of the bottom of the cap-like member from the briefcase-like assembly designed for use with a specialized stand;

FIG. 48 is a perspective view of module for a construction toy in accordance with another embodiment;

FIG. 49 is a perspective view of another module for a construction toy;

FIG. 50 is a perspective view of another module for a construction toy;

FIG. 51 is a perspective view of another module for a construction toy;

FIG. 52 is a perspective view of another module for a construction toy;

FIG. 53 is a perspective view of another module for a construction toy;

FIG. 54 is a perspective view of another module for a construction toy;

FIG. 55 is a perspective view of another module for a construction toy;

FIG. 56 is a perspective view of another module for a construction toy;

FIG. 66 is an exploded perspective view of two middle boards which don't have structural webbing between their protrusions, in accordance with another embodiment;

FIG. 67 is a perspective view of two middle boards which don't have structural webbing between their protrusions, assembled as a unit;

DETAILED DESCRIPTION OF THE FIRST EMBODIMENT

FIGS. 1-16

Figure 1:
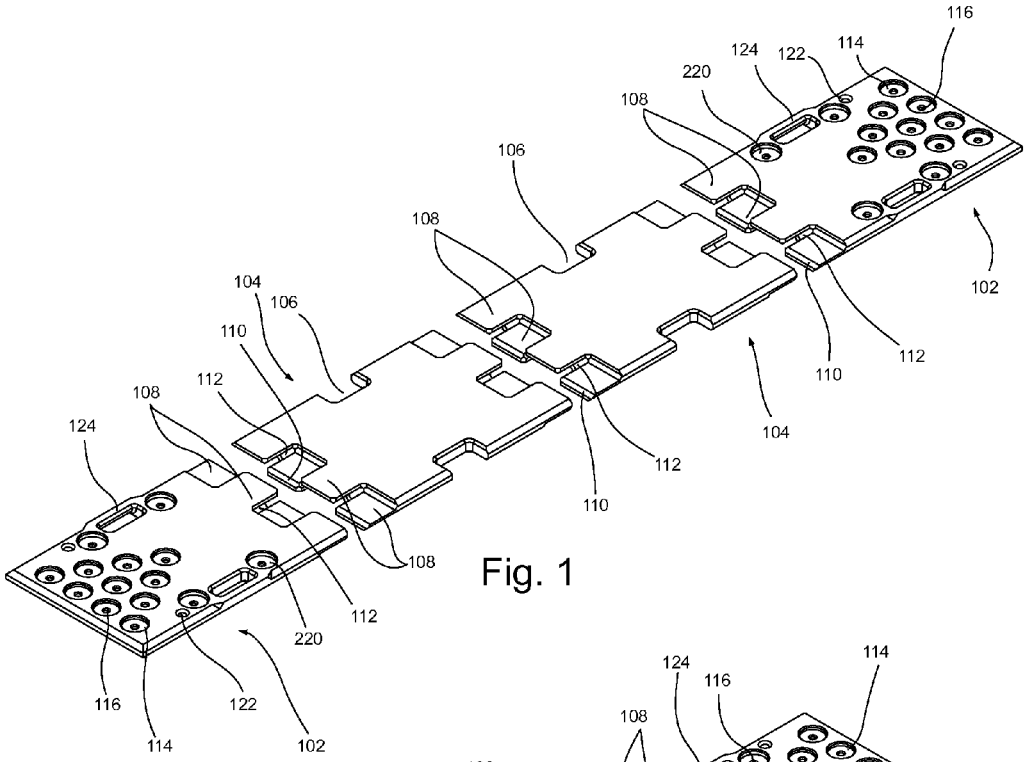
FIG. 1 is an exploded perspective view of a modular beer pong table in accordance with one embodiment.
Figure 2:
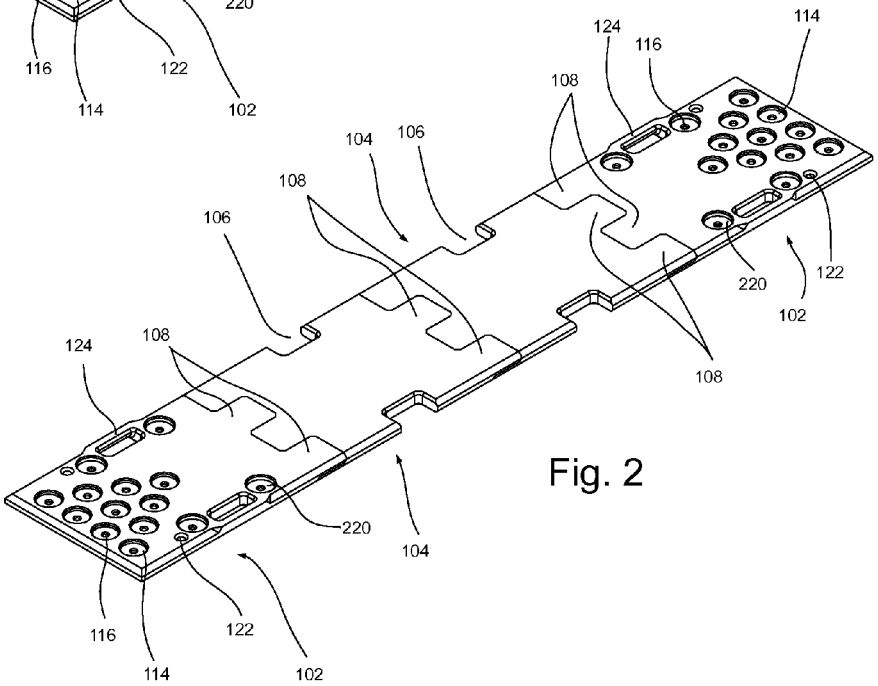
FIG. 2 is a perspective view of the modular beer pong table assembled with four planar members.
Figure 3:
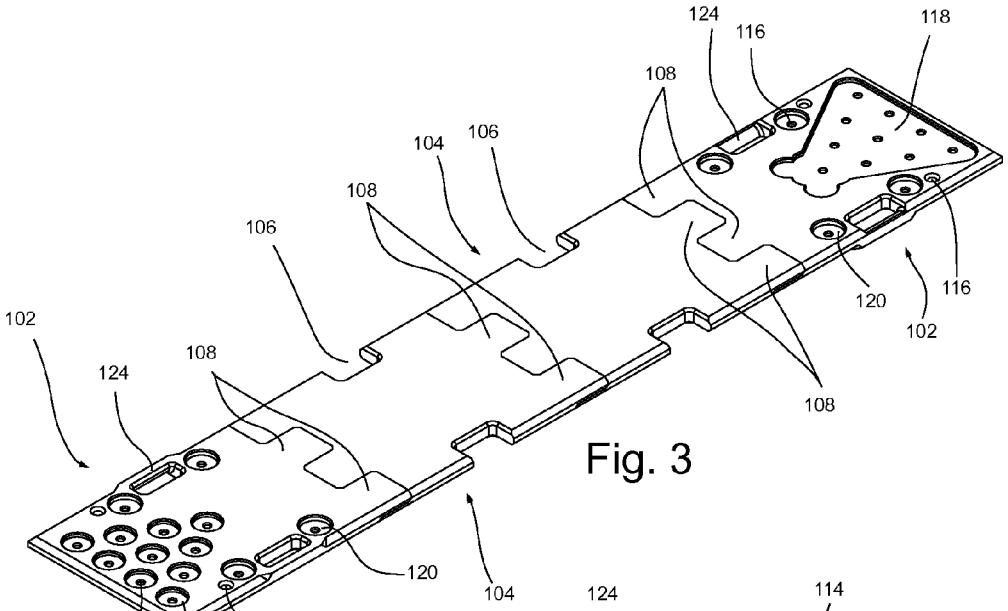
FIG. 3 is a perspective view of the modular beer pong table assembled with four planar members, one of which members is flipped around to expose a different style of playing surface.
Figure 4:
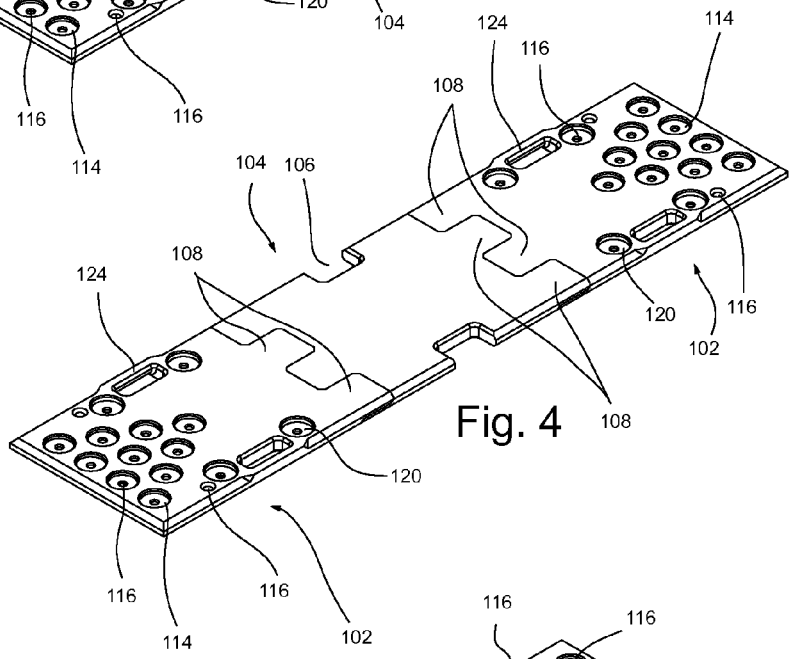
FIG. 4 is a perspective view of the modular beer pong table assembled with only three planar members.
Figure 5:
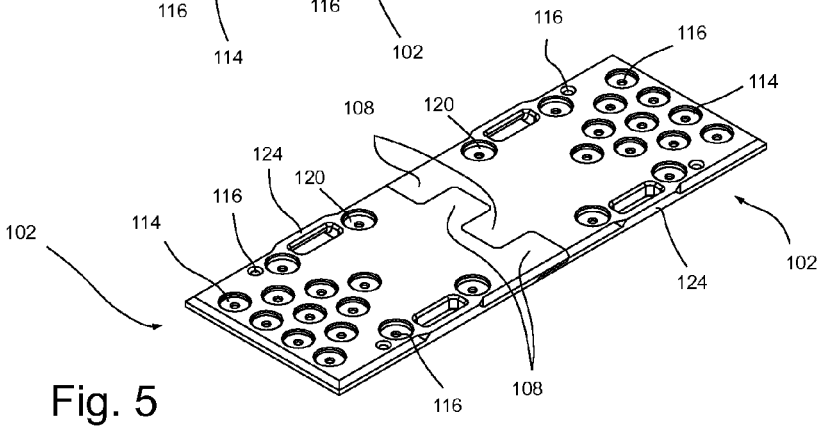
FIG. 5 is a perspective view of the modular beer pong table assembled with only two planar members.

The first embodiment is a modular beer pong table comprising four planar members as shown separated in FIG. 1. Of the four planar members, there are two end boards 102 and two middle boards 104.

Figure 6:
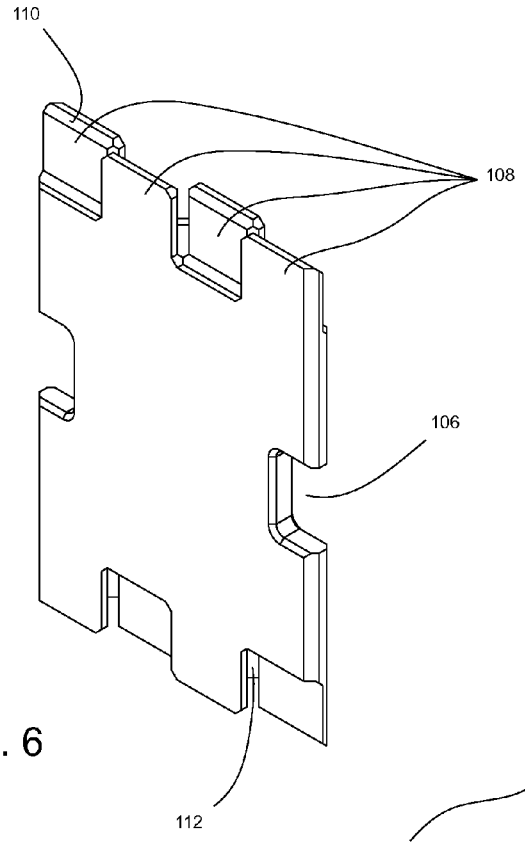
FIG. 6 is an enlarged perspective view of the front of a middle board planar member from the modular beer pong table.
Figure 7:
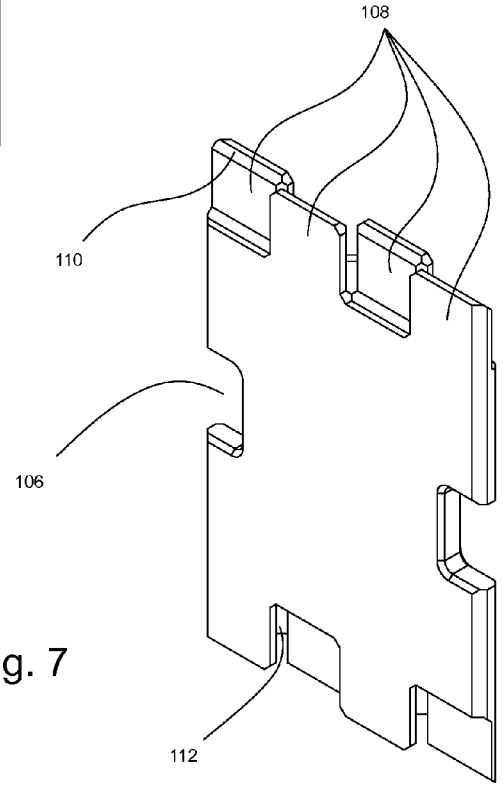
FIG. 7 is an enlarged perspective view of the back of the middle board planar member from the modular beer pong table.

The middle board 104, best shown in FIGS. 6 and 7, being flat and square shaped, has two large surfaces, each opposed to the other, and four narrow surfaces or edges. Two opposed edges of the middle board 104 each have a set of diagonally opposed protrusions 108 that occupy two rows and four columns. The protrusions have a flat and box-like shape, and protrude normally from the edge and parallel to the two large faces of the middle board 104. Only one protrusion occupies each column, and only two protrusions occupy each row so that no protrusion of either row overlaps any protrusion of the other row. In other words, and as the name suggests, each protrusion of one column is diagonally opposed to the protrusion of any adjacent column. This forms an alternating pattern of protrusions along the length of each edge that has a set of diagonally opposed protrusions 108.

Among many other advantages to be explained in the proceeding text, the design of the set of diagonally opposed protrusions 108 allows for the parts to be manufactured using common industrial molding techniques such as steam-chest molding, which molds parts from various types of beaded foam. This ability is partially a result of the beer pong table being modular, and thus the modules are small enough to fit on a mold, and partially a result of the set of diagonally opposed protrusions 108 being designed without overlap, or, in manufacturing parlance, without undercuts.

Each set of diagonally opposed protrusions 108 further comprises a structural webbing 112 between each pair of adjacent protrusions. The structural webbing 112 extends half the length of protrusion of any given set of diagonally opposed protrusions 108, and adds significant strength to each set of diagonally opposed protrusions 108 affording the protrusions greater ability to resist bending and deformation. Further, each protrusion terminates with chamfered edges 110 that facilitate a smooth mating by reducing snagging of the protrusions while sliding past each other and affording the user a greater allowable margin of error when matching up two sets of diagonally opposed protrusions 108.

Each set of diagonally opposed protrusions 108 has a symmetry about a central axis parallel to the direction of the protrusion, whereby, when flipped 180 degrees about the central axis, it is indistinguishable from its previous orientation.

The middle board 104 also has two hand grips 106; one on each edge not occupied by a set of diagonally opposed protrusions 108. The hand grips 106 take the form of recesses on the edge of the middle board 104 whereby a user can comfortably place his or her hands to get a firm commanding grip on the middle board 104.

Figure 8:
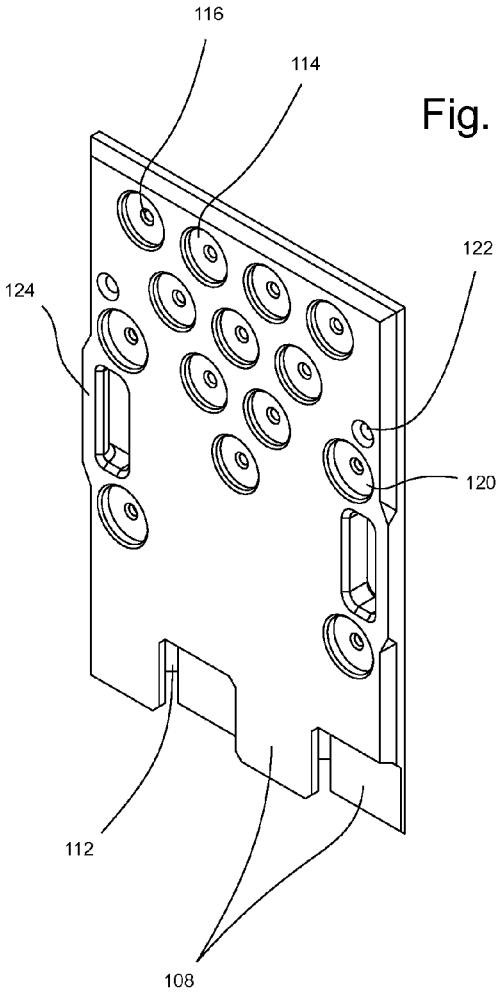
FIG. 8 is an enlarged perspective view of the front of an end board planar member from the modular beer pong table.
Figure 9:
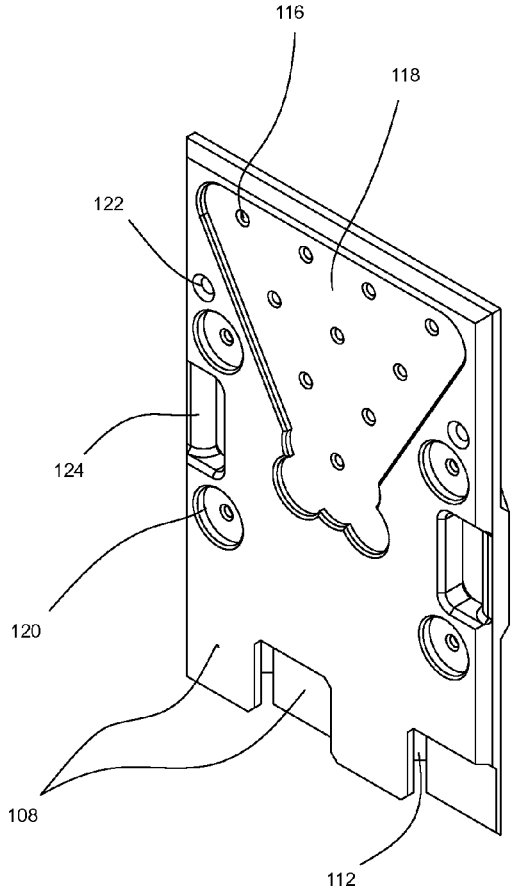
FIG. 9 is an enlarged perspective view of the back of the end board planar member from the modular beer pong table.

The end board 102, best shown in FIGS. 8 and 9, like the middle board 104, is flat and square shaped, having two large surfaces, each opposed to the other, and four narrow surfaces or edges. Only one edge of the end board 102 has a set of diagonally opposed protrusions 108 that protrude normally from the edge and parallel to the two large faces of the end board 102

The end board 102 has a triangular formation of circular depressions 114 on one of its two large surfaces and a depression for accommodating a plurality of cups 118 on the opposite large surface which mirrors the placement of the triangular formation of circular depressions 114.

Each large surface of the end board 102 further comprises four drink holders 120. The drink holders 120 are simple depressions that retain soda cans, cups, soda bottles, or other beverage containers. The placement of the drink holders 120 of one surface of the end board 102 mirror the placement of the drink holders 120 of the opposite surface of the end board 102. At the center of each drink holder 120 and each circular depression of the triangular formation of circular depressions 114 is a drainage hole 116. The drainage hole 116 is a through-hole that begins from the center of each circular depression of the triangular formation of circular depressions 114 and terminates within the depression for accommodating a plurality of cups 118 on the other side of the end board 102, or is a through-hole that begins from the center of each drink holder 120 and terminates at the center of the opposed drink holder 120 on the other side of the end board 102.

The end board 102 further comprises anchor holes 122 on either side of the triangular formation of circular depressions 114 and by each edge of the end board 102 that is adjacent to the edge having the set of diagonally opposed protrusions 108. The anchor hole 122 is a through-hole large enough to accommodate a medium gauge rope.

On each edge of the end board 102 that is adjacent to the edge having the set of diagonally opposed protrusions 108 there is a handle 124. Each handle 124 is formed by a cut-out in the end board 102. One side of each handle 124 is flush with one of the two large surfaces of the end board 102. In this particular embodiment, the handles 124 are flush with the surface comprising the triangular formation of circular depressions 114.

Figure 10:
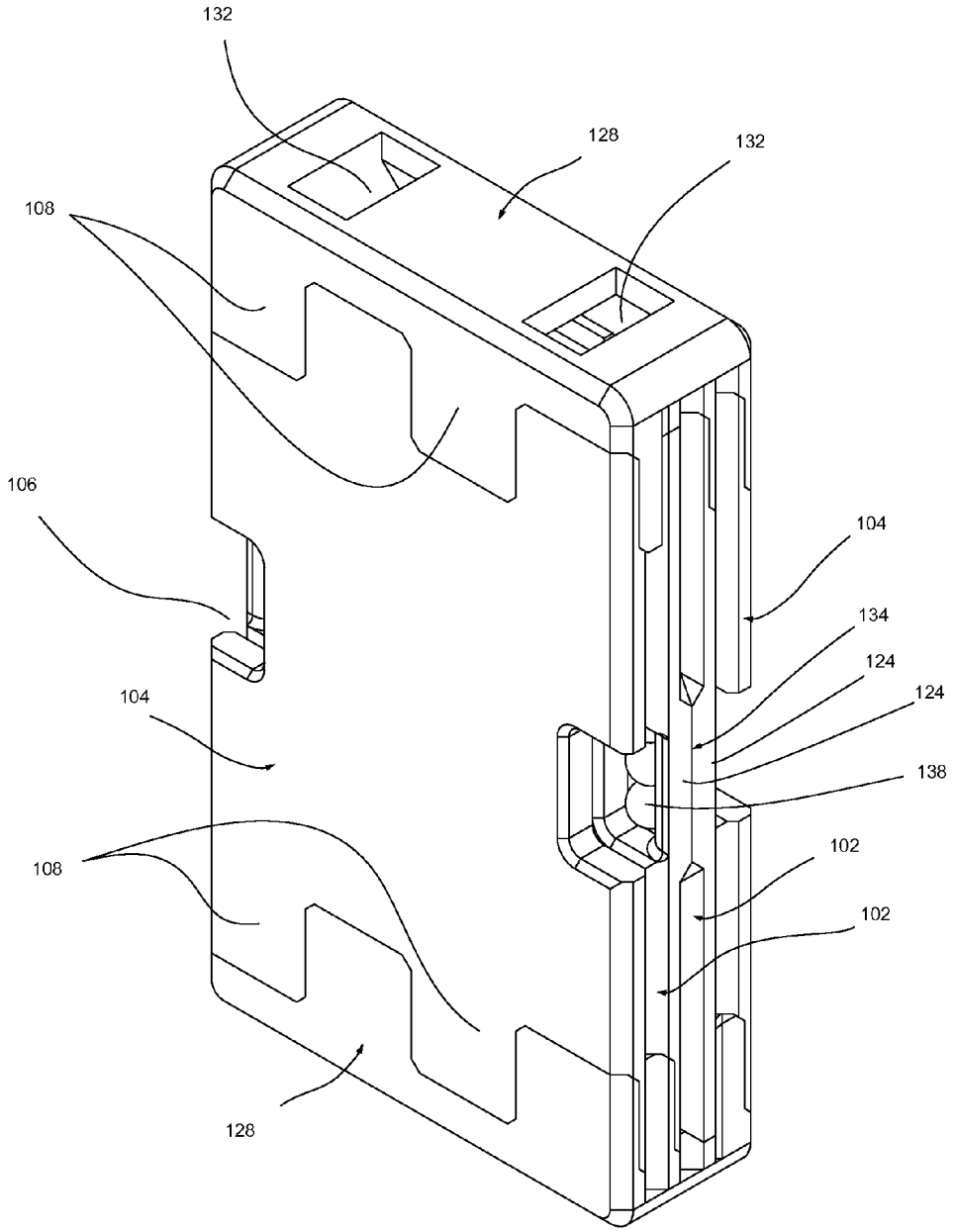
FIG. 10 is a perspective view of the modular beer pong table reassembled as a briefcase-like assembly.
Figure 13:
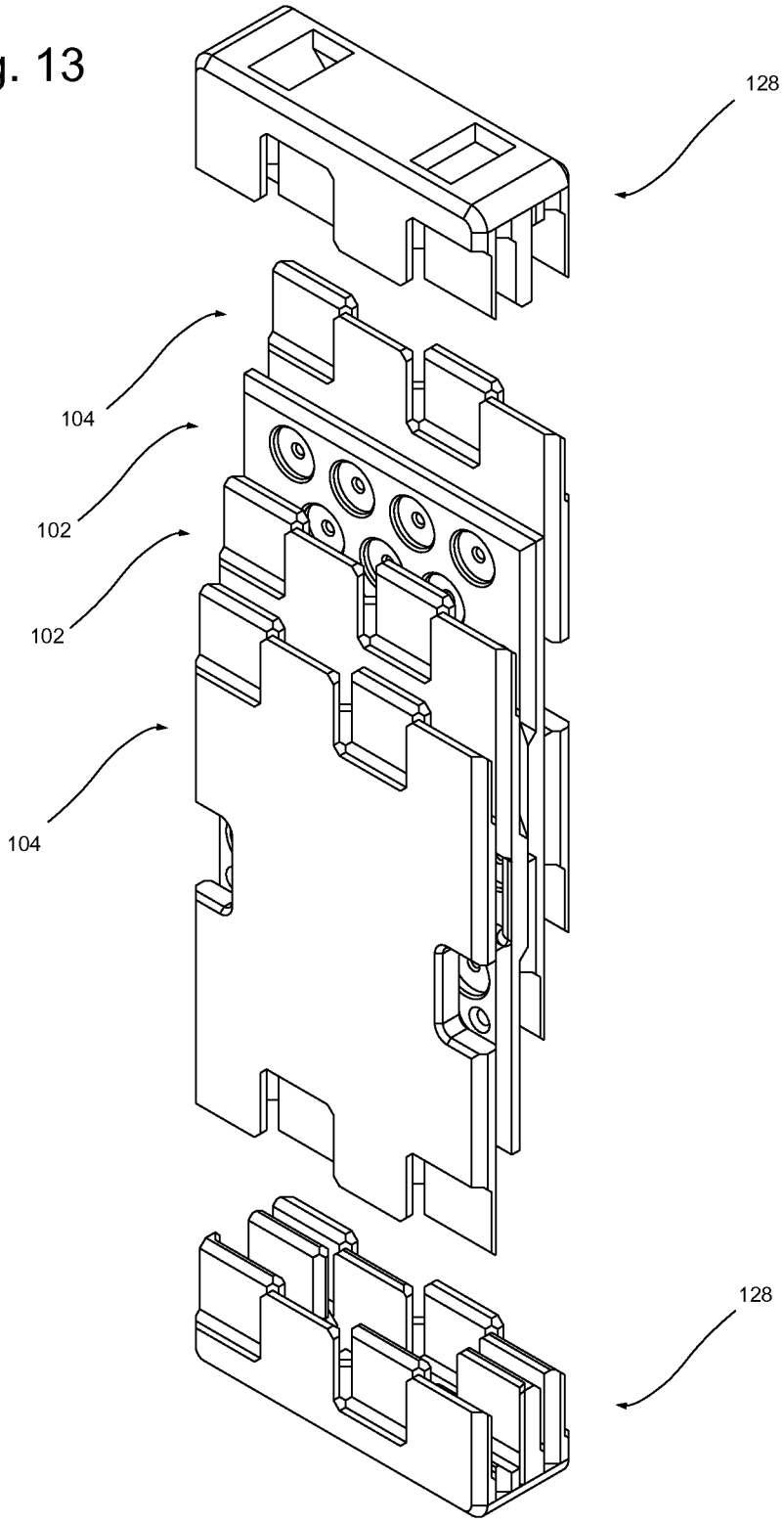
FIG. 13 is an exploded perspective view of the briefcase-like assembly.
Figure 14:
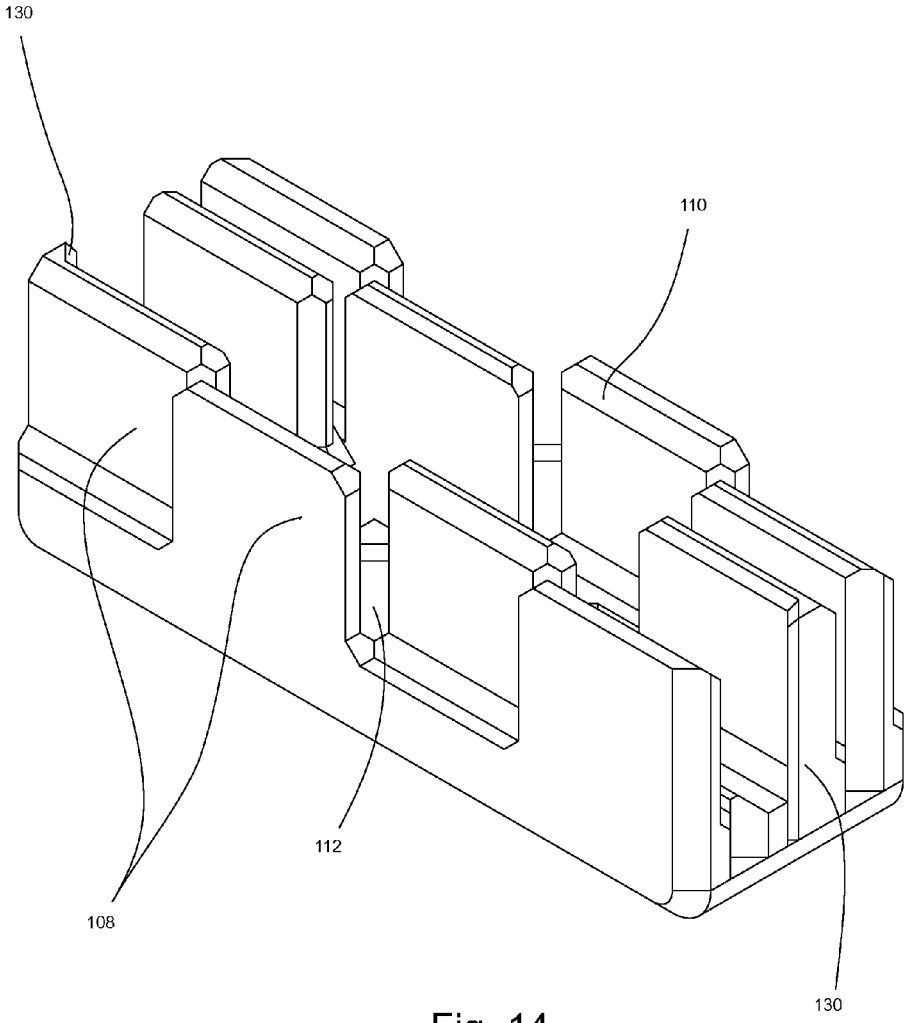
FIG. 14 is an enlarged perspective view of a cap-like member of the briefcase-like assembly.

In addition to the four planar members, the modular beer pong table of this embodiment further comprises two cap-like members 128, best shown in FIGS. 13 and 14, that combine with the four planar members to form a briefcase-like assembly 126, depicted in FIG. 10, and explained in the operation section that follows. Each cap like member 128 is box-like in shape and has a length equal to the length of the edge of the end board 102 that is opposite the set of diagonally opposed protrusions 108, and a width equal to the combined thickness of the four planar members. The cap-like member 128 further comprises two sets of diagonally opposed protrusions 108, additional protrusions or an incomplete set of diagonally opposed protrusions 108, and a cradle 130. The purpose of the cradle 130 is explained in the operation section that follows. The cap-like member 128 further comprises two recess grips 132 at its top.

Operation of the First Embodiment

Using the handle 124 of the end board 102 or the hand grip 106 of the middle board 104, the user can connect two planar members together by interposingly mating a set of diagonally opposed protrusions 108 of one planar member with a set of diagonally opposed protrusions 108 of another planar member. This is accomplished by matching up any set of diagonally opposed protrusions 108 of both planar members, while both of the large surfaces of one planar member occupy the same planes as the large surfaces of the other planar member.

Assembly of the planar members can be easily accomplished by just one user by placing an end board 102 with its edge that is opposite the set of diagonally opposed protrusions 108 on the ground, and with the opposite edge, the edge comprising the set of diagonally opposed protrusions 108, upright and leaning against a vertical surface or the users legs, and then matching up a set of diagonally opposed protrusions 108 of any other planar member with the set diagonally opposed protrusions 108 of the end board 102, and pressing the boards together with the floor pushing back.

Two users can also easily assemble the modular beer pong table by each grabbing a planar member and, as described above, matching up sets of diagonally opposed protrusions 108, and with each user pushing against the other to interposingly mate the two sets of diagonally opposed protrusions 108.

The geometry of any set of diagonally opposed protrusions 108 restricts the degree of freedom of two planar members being mated, to only along an axis parallel to the direction of protrusion of the mating sets of diagonally opposed protrusions 108. Once the planar members are completely mated, friction between the mated surfaces effectively eliminates the remaining degree of freedom and prevents the planar members from coming apart while the modular beer pong table is in use.

To completely assemble the modular beer pong table into its playable form, one end board 102 is mated to a middle board 104 in a manner as described above. Then, the middle board 104 of the currently two board assembly is mated to the other middle board 104. Lastly, the remaining end board 102 is mated with the other three planar members via the terminal middle board 104.

Due to the symmetry of any set of diagonally opposed protrusions 108, users, within reason, need not worry about how the boards are oriented with respect to one another. No matter how any two sets of diagonally opposed protrusion 108 are matched up they will always be compatible. It should be understood that the planar members must be assembled as described above, which is to say, generally, that two sets of diagonally opposed protrusions 108 must be properly aligned in order to be mated.

This symmetric nature of the sets of diagonally opposed protrusions 108 afford many advantages over the prior art. One such advantage is being able to choose the size of the modular beer pong table by including or excluding planar members as depicted in FIGS. 1-5. Another such advantage is the ability to effortlessly assemble the modular beer pong table without having to worry about which way the planar members need to be assembled. To exemplify this fact, the middle board 104 is symmetrically identical when flipped about three different axes emanating from the center of the middle board 104, the axes all being perpendicular to each other with two of the three axes being parallel with two adjacent edges of the middle board 104.

The end board 102 also benefits from the symmetry of its set of diagonally opposed protrusions 108, affording the planar member the ability to be flipped over while maintaining compatibility with any other set of diagonally opposed protrusions 108, whereby the user can choose to use the triangular formation of circular depressions 114 on one side of the end board 102 or the depression for accommodating a plurality of cups 118 on the opposite side of the end board 102. The triangular formation of circular depressions 114 offers the convenience of guiding the cups 40 into perfect initial and subsequent formations, called a rack and re-rack respectively in beer pong parlance, while sacrificing the freedom of being able to place the cups 40 in any desired subsequent formation or re-rack. The depression for accommodating a plurality of cups 118 allows for a perfect initial rack, due to its unique shape, being a composite of a large triangle and smaller circles, but sacrifices perfectly guided re-racks for greater freedom of cup placement.

Figure 15:
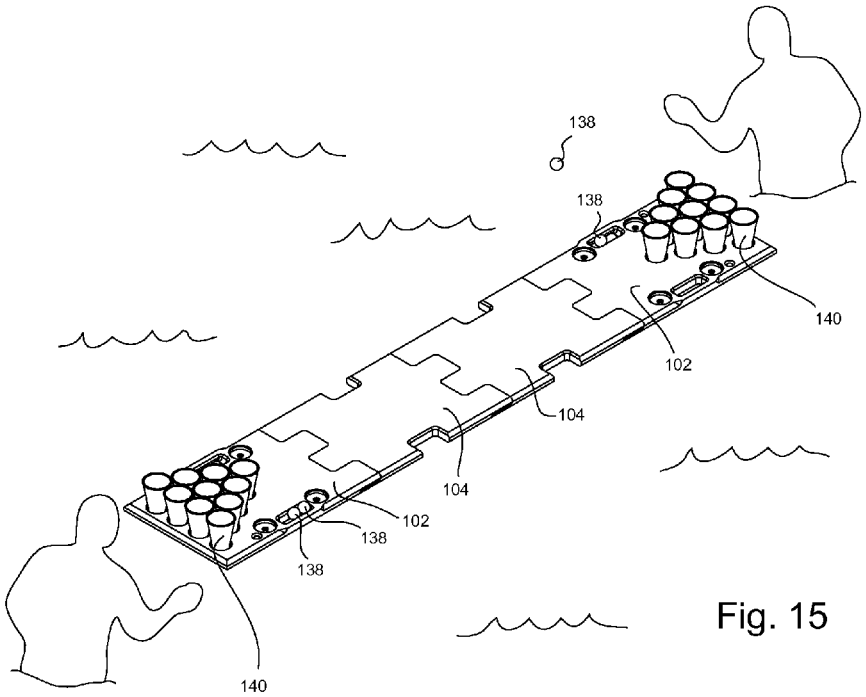
FIG. 15 is a perspective view of the modular beer pong table being used in a body of water.

The modular beer pong table can be made of many different materials such as, but not limited to, wood, plastic, metal, composite board, and various expanded or extruded foams. At present, I contemplate the use of expanded polypropylene for this embodiment, but other materials are suitable. Manufacturing the modular beer pong table from a material less dense than water will give the added advantage of buoyancy, whereby allowing users to play beer pong in the pool as depicted in FIG. 15. Being made of foam, or other similar floatable materials, the modular beer pong table will be unsusceptible to decommissioning by punctures that currently plague most of the prior art with respect to floating beer pong tables.

A user may also choose to lay the modular beer pong table on the tailgate of a truck or on a small table or other similar structure where the modular beer pong table overhangs the platform which it is set on. The structural webbing 112 incorporated into the sets of diagonally opposed protrusions 108, provides the strength required of the modular beer pong table when overhung from a structure or platform like those just mentioned. Floating foam tables of the prior art lack the strength and rigidity to withstand the same, in spite of the fact that most are not modular.

The strength afforded by the structural webbing 112 also affords a user the ability to hang the modular beer pong table by stringing a rope or similar item through each of the anchor holes 122 and then tying the rope to a structure such as a tent or tree. The placement of the anchor holes 122 allow the modular beer pong table to be hung in such a way that one piece of rope or other similar item runs along the length of the bottom of the table, and then up and out through the anchor holes 122 at opposite ends, and then from there tied to whatever structure is being used as a support, and the same being repeated for the other side of the modular beer pong table, thereby adding more structural support to the already strong connections between planar members.

The anchor holes 122 can also be used to anchor the modular beer pong table in a pool so as to prevent it from being blown away by a breeze. The low profile of the table also adds to its ability to resist being blown by the wind, which much of the prior art regarding floating beer pong tables suffers from.

After a user is finished with the modular beer pong table, they can disassemble the planar members, and, using the cap-like member 128 assemble the parts into a briefcase-like assembly as shown in FIGS. 10 and 13. The two sets of diagonally opposed protrusion 108 of the cap-like member 128 function in the same manners as those of the end board 102 and the middle board 104. The additional protrusions or incomplete set of diagonally opposed protrusions 108 of the cap-like member 128 also function in the same manner. Some of the protrusions are missing only for the sake of reducing friction between mating parts and for the sake of reducing manufacturing costs as there is less material involved in making the part. A complete set of diagonally opposed protrusions 108 can be used in place of the incomplete set of diagonally opposed protrusions 108. The cradle 130 receives the edge of the end board 102 that is opposite the edge with the set of diagonally opposed protrusions 108.

To assemble the briefcase-like assembly 126, the user should first hold both of the end boards 102 by the handles 124 in such a way that handles 124 meet flush, forming a robust handle 134, and also in such a way that the sets of diagonally opposed protrusions 108 are at opposites ends of each other. The user should then insert the two end boards 102 into the center of one cap-like member 128 in the same manner used to mate two planar members. The user can then insert the two middle boards 104 into the cap-like member 128 on either side of the two end boards 102. The resulting exposed portions of the four planar members will then be identical with the orientation of their opposite ends, and thus will perfectly receive the other cap-like member 128.

Figure 16:
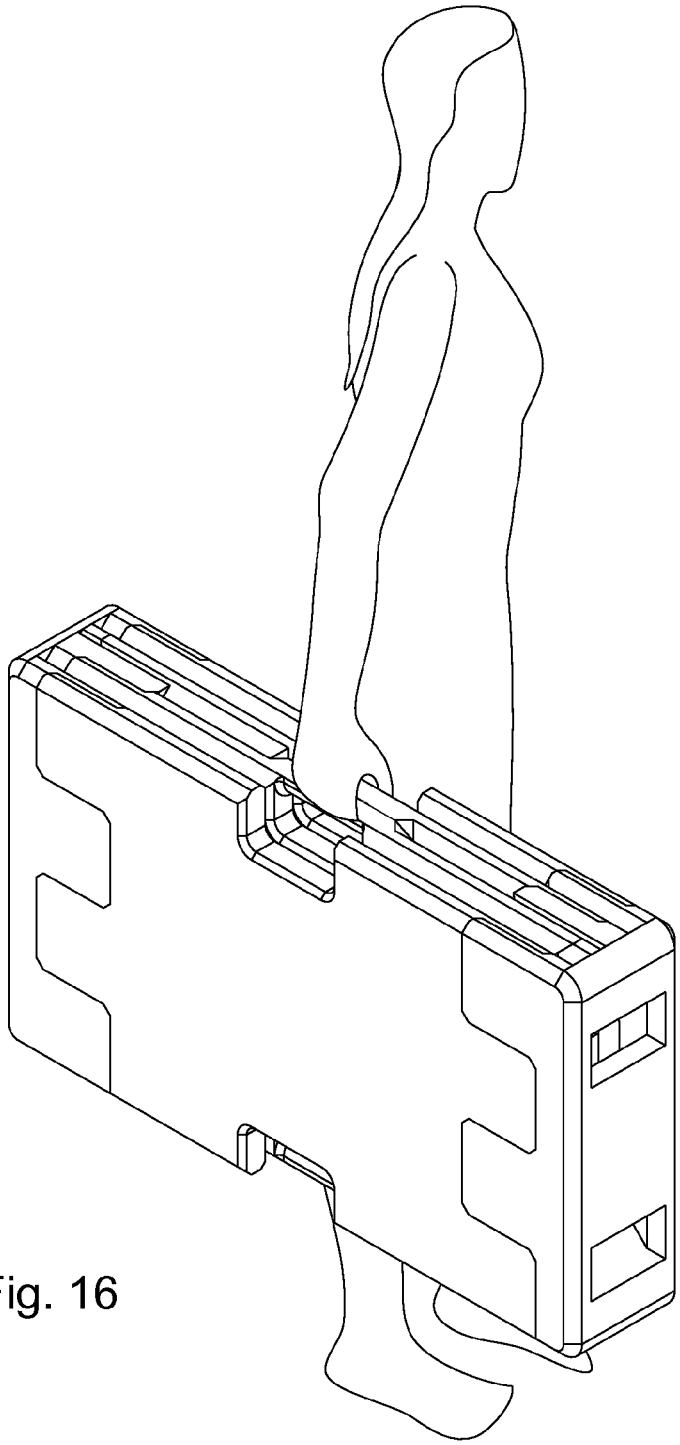
FIG. 16 is a perspective view of the briefcase-like assembly being held by a user.

The briefcase-like assembly 126 provides for an ideal way to transport and store the modular beer pong table. Conveniently, the robust handles 134 on either side of the briefcase-like assembly 126 are designed to each form a ball retaining space 136 with the ability to retain a plurality of ping pong balls 138 as depicted in FIGS. 10-12. A user can use one robust handle 134 for carrying the modular beer pong table, as shown in FIG. 16, while employing the other robust handle 134 for securely storing ping pong balls 138. When a user wants to disassemble the briefcase-like assembly 126, they can use the recess grip 132 of either cap-like member 128 to pull the cap-like member 128 from the four planar members. The user can then proceed to remove the two end boards 102 and the two middle boards 104 from the other cap-like member 128.

DETAILED DESCRIPTION OF THE SECOND EMBODIMENT

FIGS. 17-34

Figure 17:
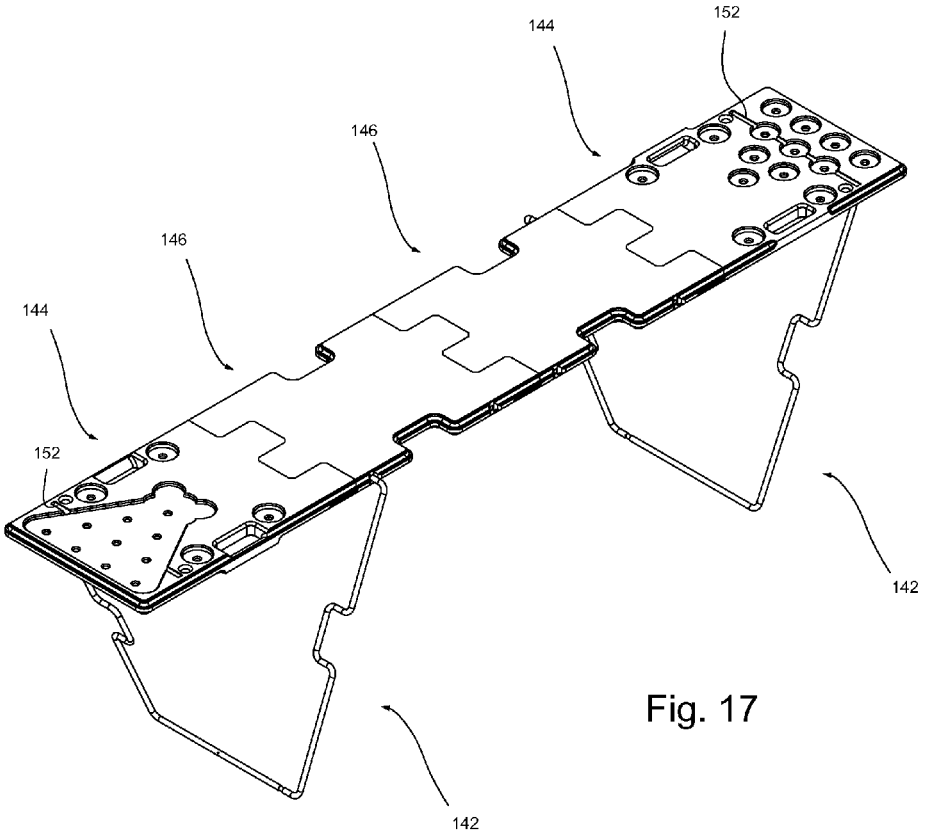
FIG. 17 is a perspective view of a modular beer pong table designed for use with a specialized stand in accordance with another embodiment.

FIG. 17 shows a modular beer pong table that matches the functionality of the first embodiment while being designed for use with a specialized stand 142. The stand 142 comprises a female tube 154 and a male tube 160.

The male tube 160 has a shape similar to the outline of half of a square, and comprises an upper insertion tube 162 at one end, a lower insertion tube 164 at the other end, and a guiding cutout 166 in the lower insertion tube 164.

The female tube 154 also has a shape similar to the outline of half of a square, and comprises a drilled hole 56 at one end.

Figure 19:
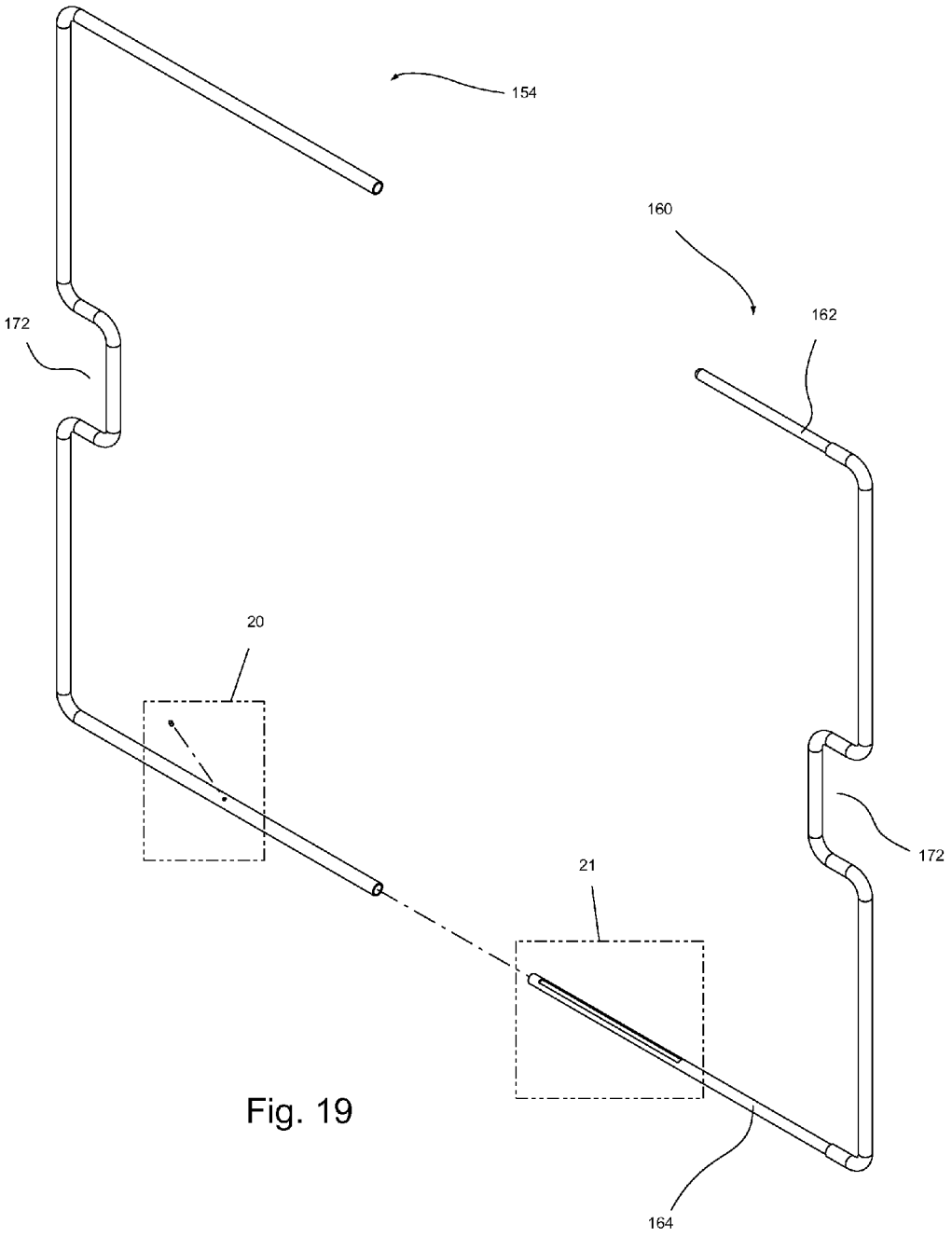
FIG. 19 is an enlarged exploded perspective view of the specialized stand.
Figure 20:
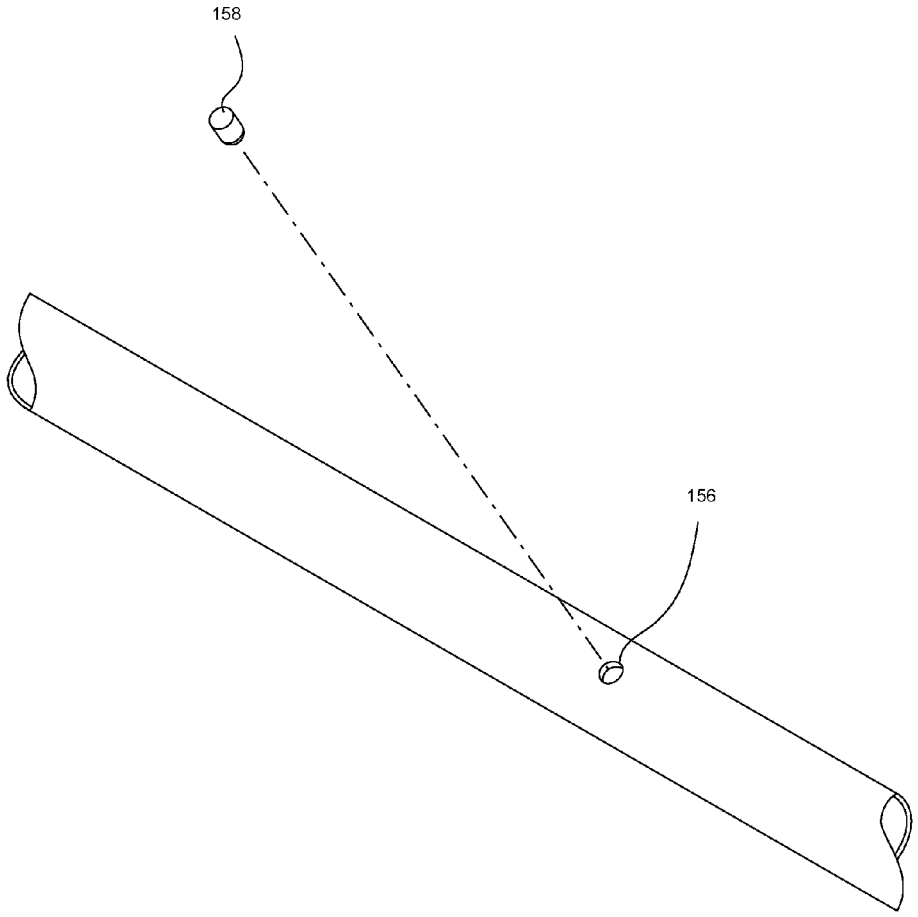
FIG. 20 is a detailed perspective view of a portion of the specialized stand as taken from a sectioned area labeled 20 in FIG. 19.
Figure 21:
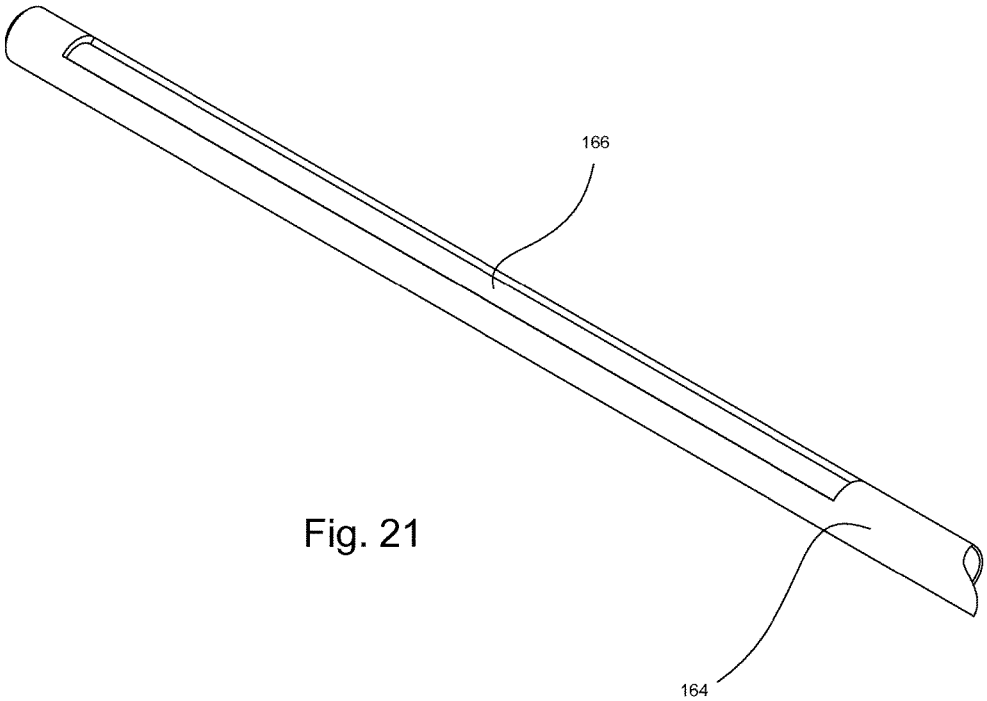
FIG. 21 is a detailed perspective view of a portion of the specialized stand as taken from a sectioned area labeled 21 in FIG. 19.

To construct the stand 142, the lower insertion tube 164 of the male tube 160, shown in FIG. 21, is inserted into the end of the female tube 154 having the drilled hole 156 as depicted in FIG. 19. Then, a locking pin 158, shown in FIG. 20, is inserted into the drilled hole 156 so that it also enters the guiding cutout 166 of the lower insertion tube 164 of the male tube 160. The locking pin 158 is then permanently secured in place by any suitable means such as welding.

The male tube 160 of the constructed stand 142 has the ability to move in and out of the female tube 154 and has the ability to pivot about an axis centered in and longitudinal to the lower insertion tube 164 in a predetermined manner as controlled by the shape of the guiding cutout 166 of the male tube 160.

Figure 32:
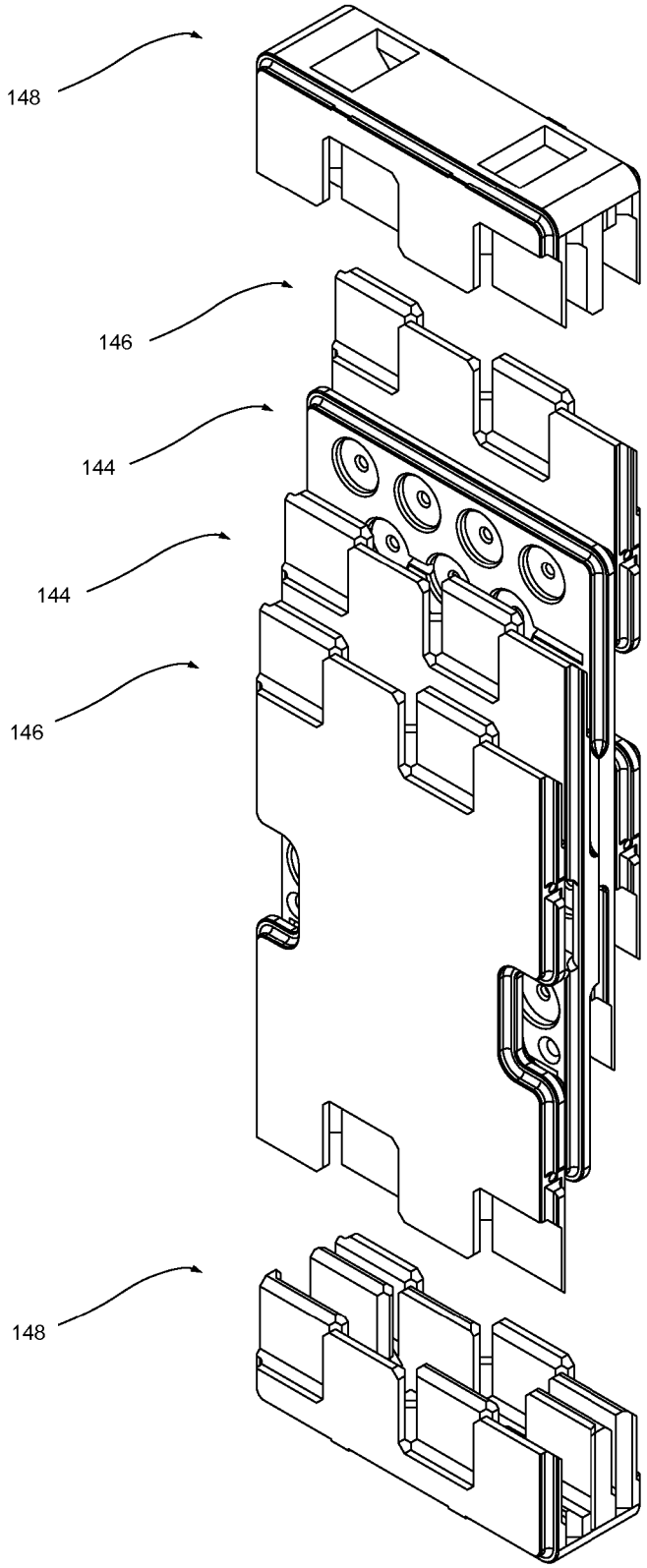
FIG. 32 is an exploded perspective view of the briefcase-like assembly designed for use with a specialized stand.
Figure 33:
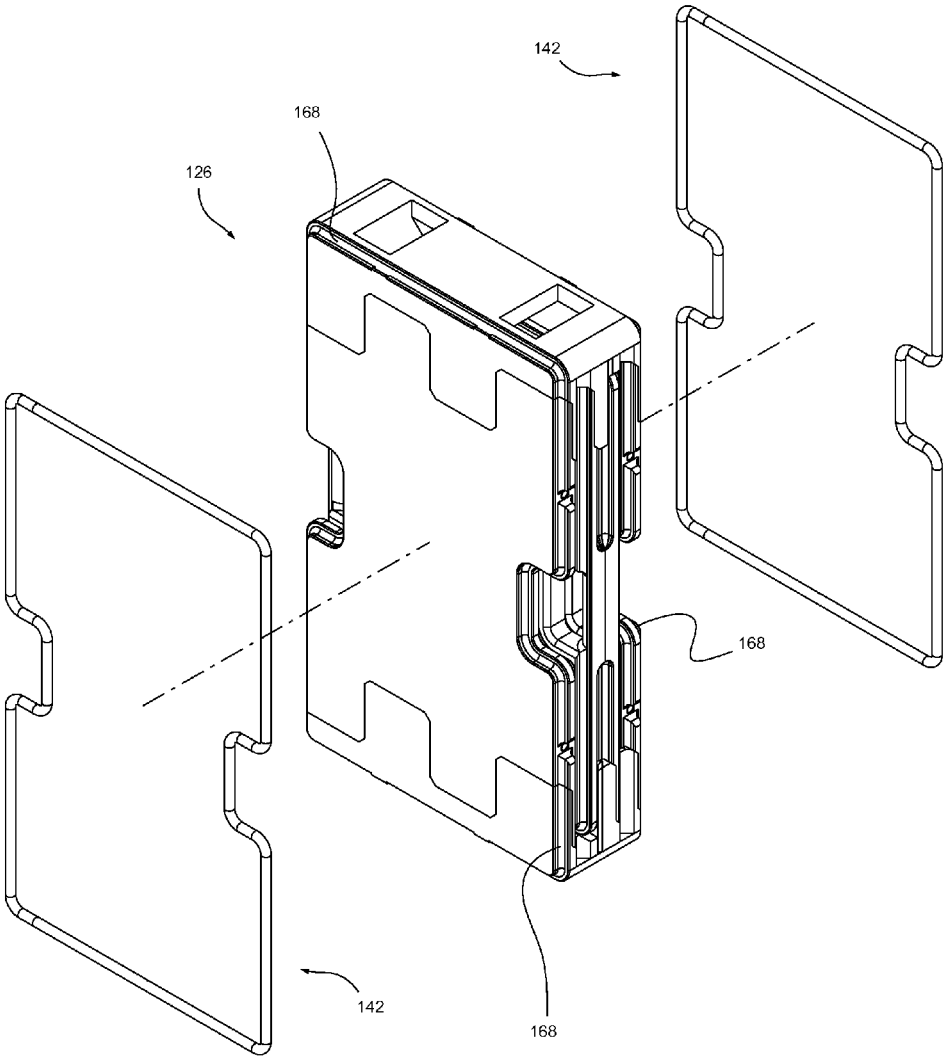
FIG. 33 is an exploded perspective view of the briefcase-like assembly designed for use with a specialized stand and two specialized stands.

A stand accommodating middle board 146, and a stand accommodating cap-like member 148 both have a system of channels 168 that combine in the briefcase-like assembly 126, FIG. 32, to form one continuous channel per each perimeter of the largest faces of the briefcase-like assembly as shown in FIG. 33. The stand accommodating end board 144 has features similar to that of the system of channels, but they are purely aesthetic.

The stand accommodating middle board 146 also has two stand insertion holes 150, as shown in FIGS. 27 and 28, on each edge not occupied by a set of diagonally opposed protrusions 108.

The stand accommodating end board 144 has two latching channels 152; one on each of the largest surfaces as shown in FIGS. 25 and 26.

The stand accommodating cap-like member 148 also has channel overhangs 170 along the perimeter of its system of channels 168 as shown in FIGS. 29-31 and FIG. 34.

Operation of the Second Embodiment

Figure 18:
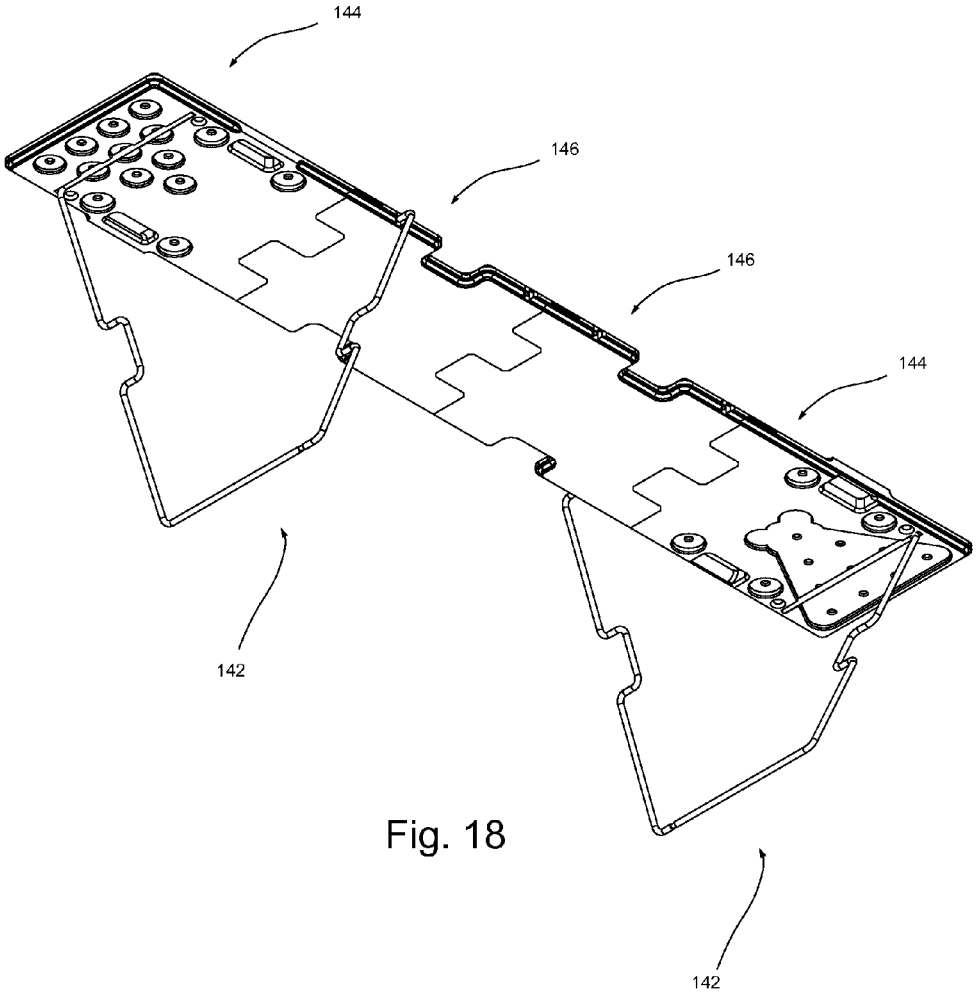
FIG. 18 is a perspective view of the modular beer pong table designed for use with a specialized stand from below the table.
Figure 23:
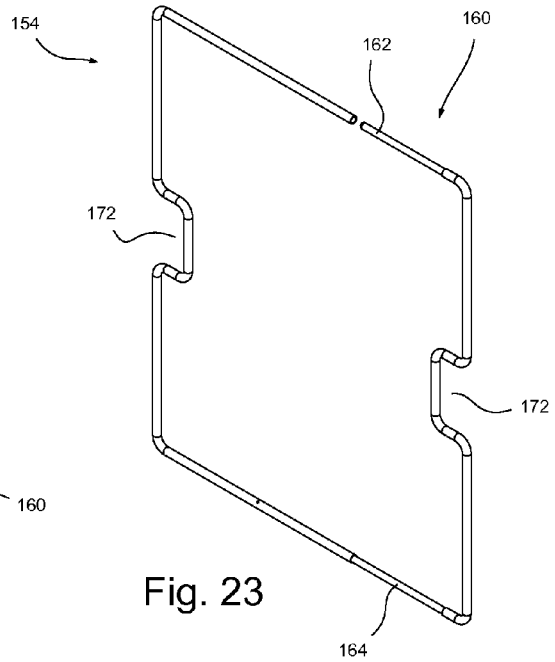
FIG. 23 is a perspective view of the specialized stand in its open state.
Figure 24:
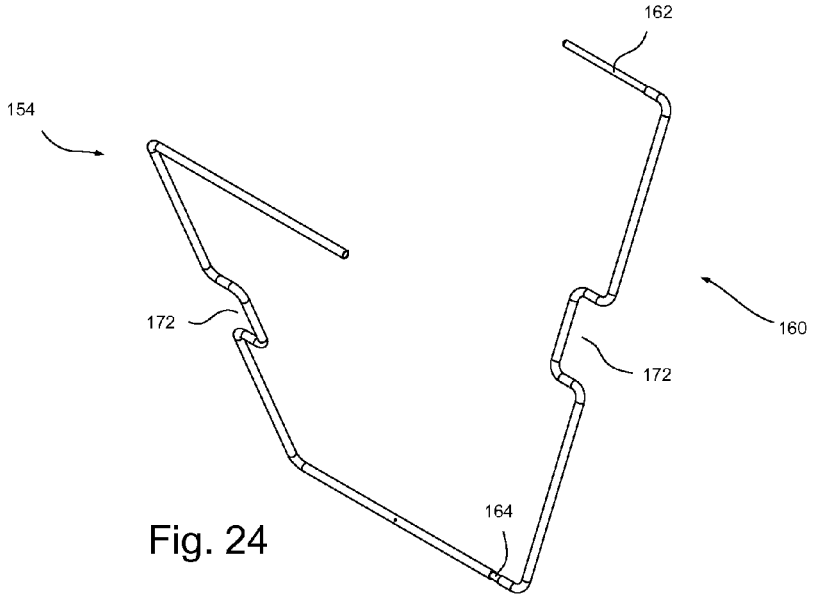
FIG. 24 is a perspective view of the specialized stand in its splayed state.

If a user desires to use the stands 142 to elevate the modular beer pong table of the second embodiment, they lay the table on the ground with the desire playing surface face down. Then, they open one stand as depicted in FIG. 23, and then splay the legs of the stand until they resist further pivoting as depicted in FIG. 24. They should then proceed to insert the upper insertion tube 162 of the male tube 160 into the stand insertion hole 150 of the stand accommodating middle board 146. They should then snap the splayed end of the other leg, the female tube 154, into the latching channel 152 of the stand accommodating end board 144. After repeating this process with the other stand 142 at the other end of the modular beer pong table, the user can then flip the modular beer pong table over and onto the two attached stands 142 so that the modular beer pong table is elevated off of the ground as shown in FIG. 17. FIG. 18 shows how the attached stand 142 attach to the modular beer pong table via the latching channels 152 of the two stand accommodating end boards 144.

Figure 22:
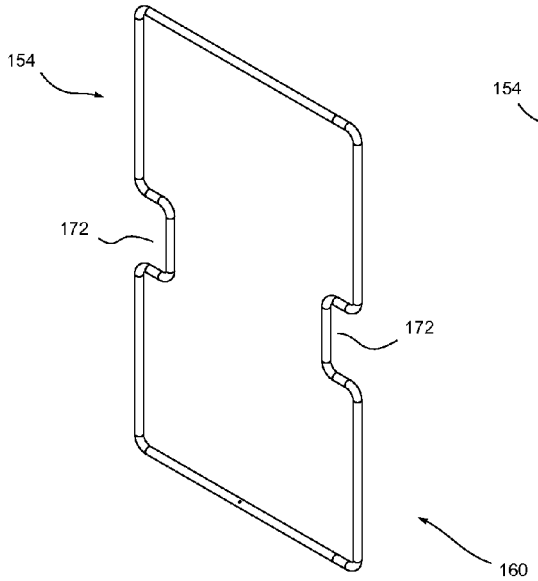
FIG. 22 is a perspective view of the specialized stand in its closed state.
Figure 34:
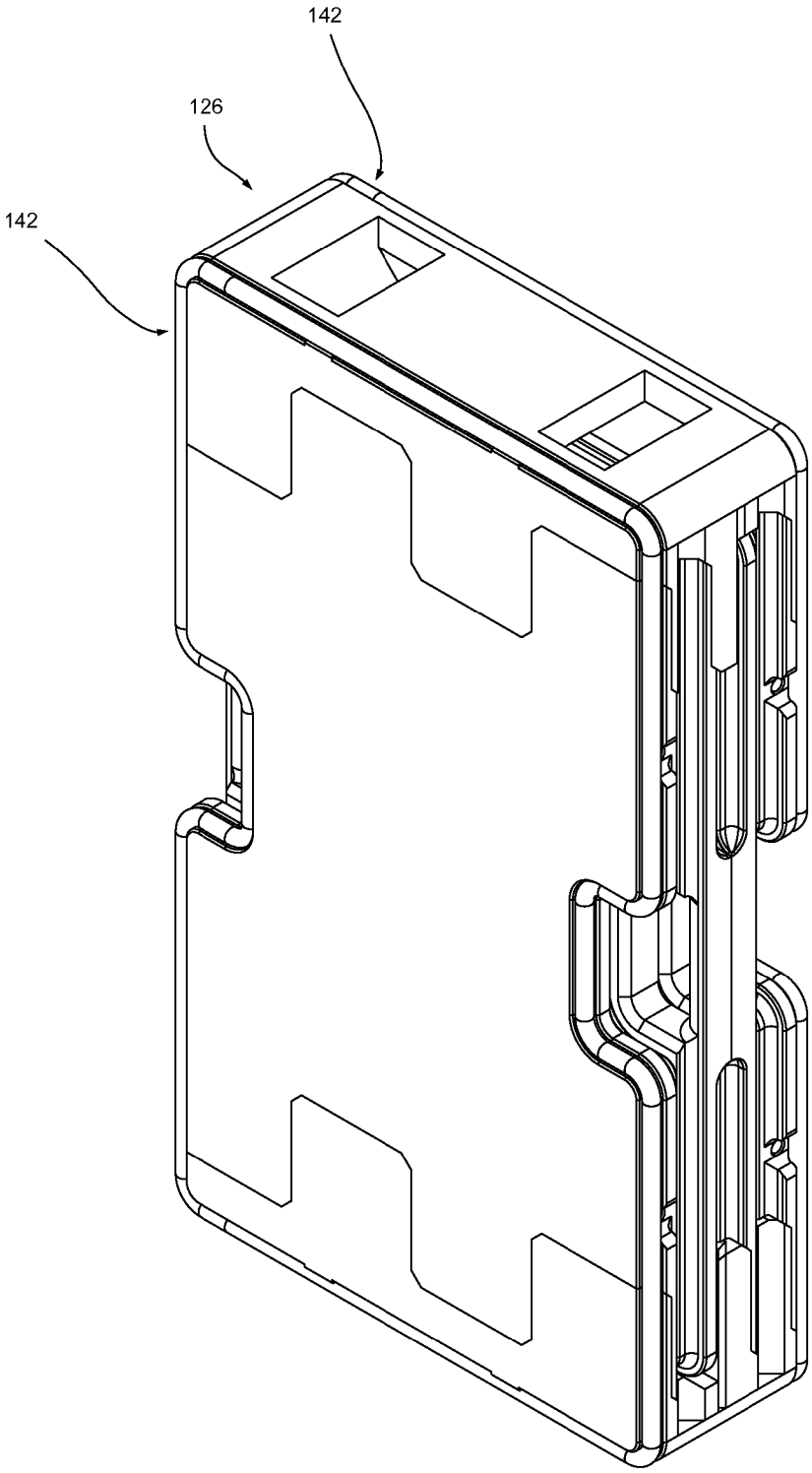
FIG. 34 is a perspective view of the briefcase-like assembly designed for use with a specialized stand and two specialized stands assembled as a unit.

When a user desires to put away the modular beer pong table, they remove the stands 142 in the reverse manner that they attached the stands 142. They should then close the stands 142 as shown in FIG. 22. Once the stands have been closed and the briefcase-like assembly 126 has been assembled, the user can then snap the stands 142 into the continuous channels formed by the system of channels 168 via the channel overhangs 170 of the stand accommodating cap-like member 148 as depicted in FIGS. 33 and 34. The stands have a hand grip contour 172 that line up with the handle area of the briefcase-like assembly 126 ensuring that the attached stands do not hinder the use of the robust handles 134. The modular beer pong table and its stands 142 can now be transported and stored as a unit.

DETAILED DESCRIPTION OF THE THIRD EMBODIMENT

FIGS. 35-38

The third embodiment describes a method for producing composite module that happens to have a similar form to the planar members of the previous embodiments, but is actually independent of any specific application. In other words, the third embodiment is not to be construed as pertaining exclusively to the use in a modular beer pong table.

Figure 35:
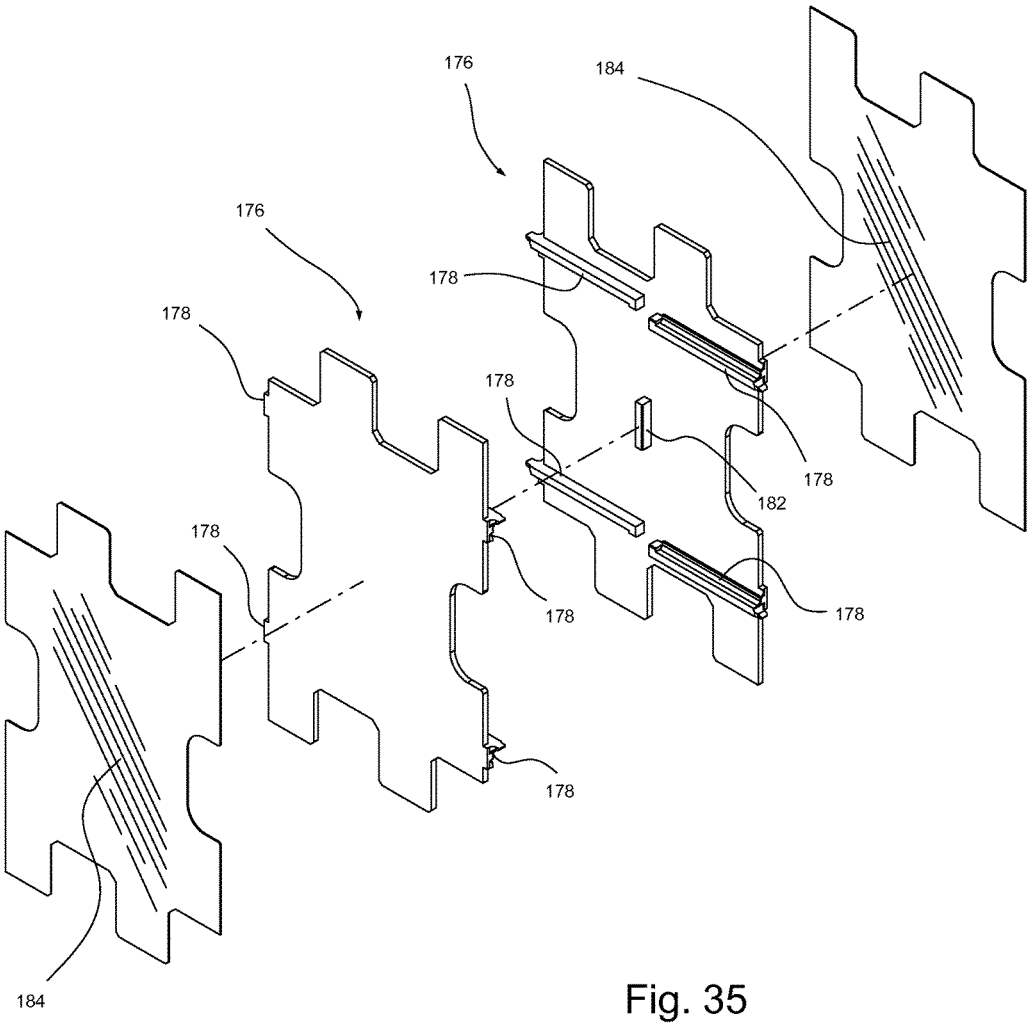
FIG. 35 is an exploded perspective view of the initial components of a composite middle board for a modular beer pong table in accordance with another embodiment.

The third embodiment is a composite module having a soft foam edge and two plastic laminated hard foam surfaces. FIG. 35 shows an exploded view of four of the five components.

Figure 36:
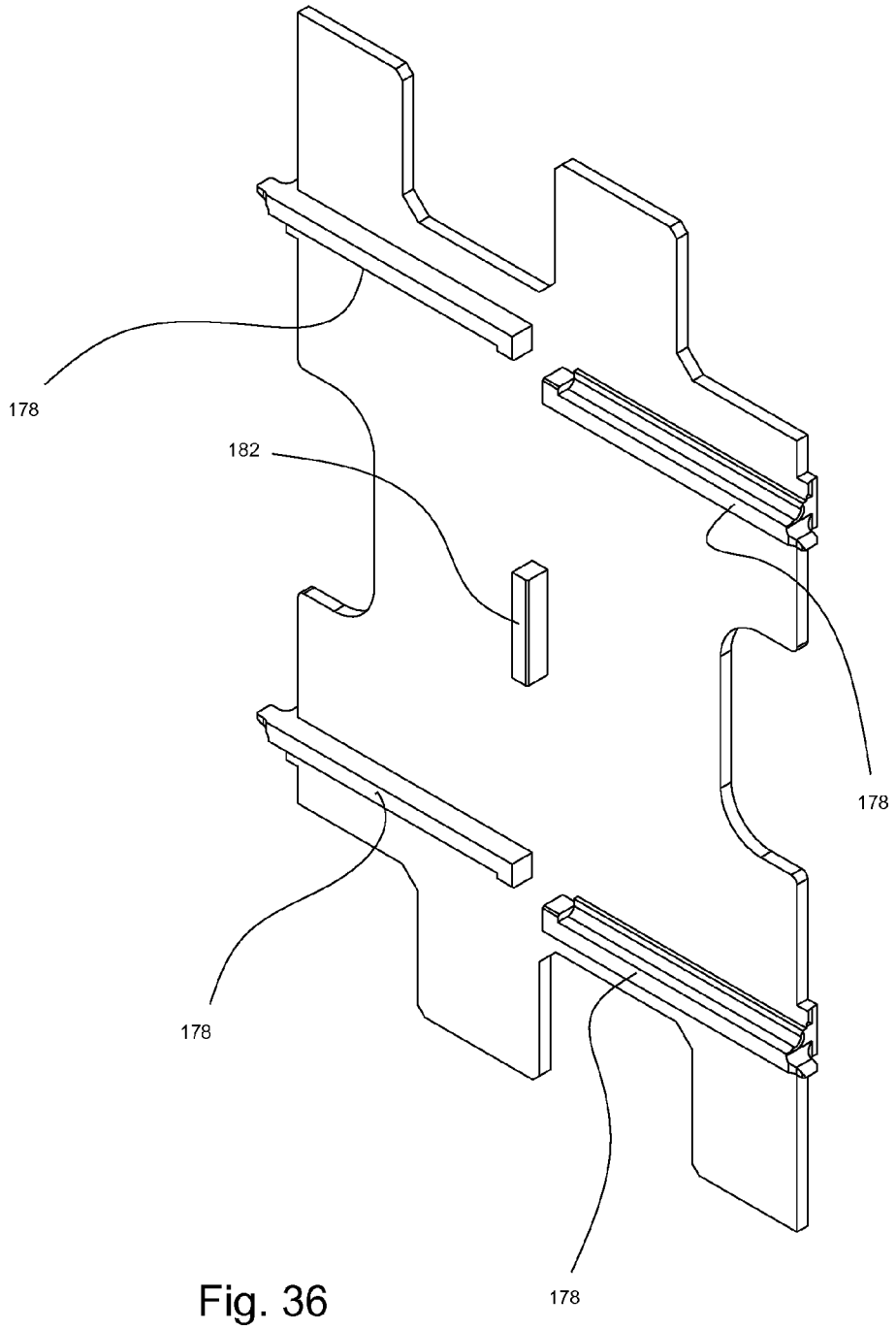
FIG. 36 is an enlarged perspective view of a hard foam shell from the composite middle board.
Figure 37:
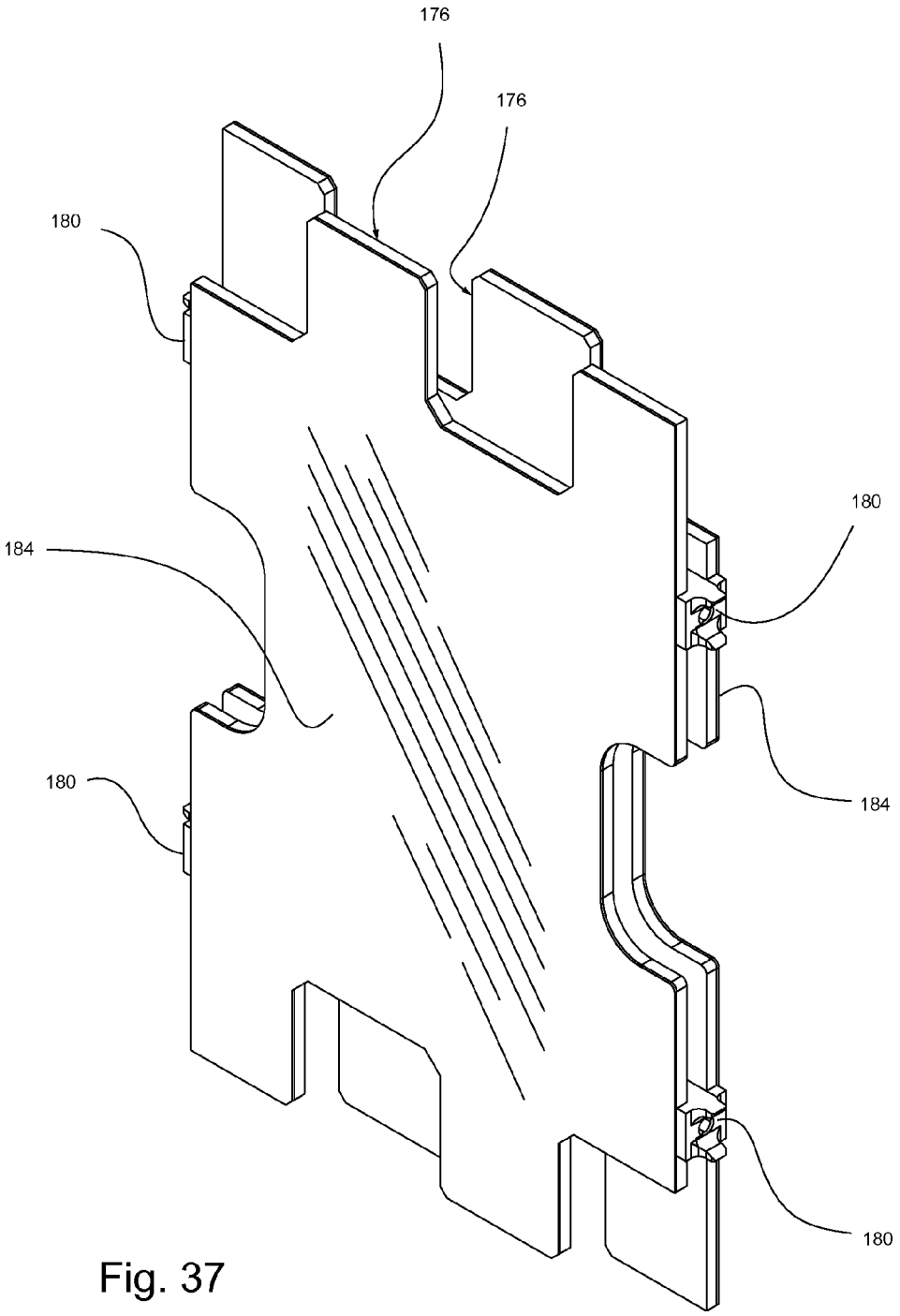
FIG. 37 is an enlarged perspective view of two hard foam shells and two plastic panels assembled as a unit.
Figure 38:
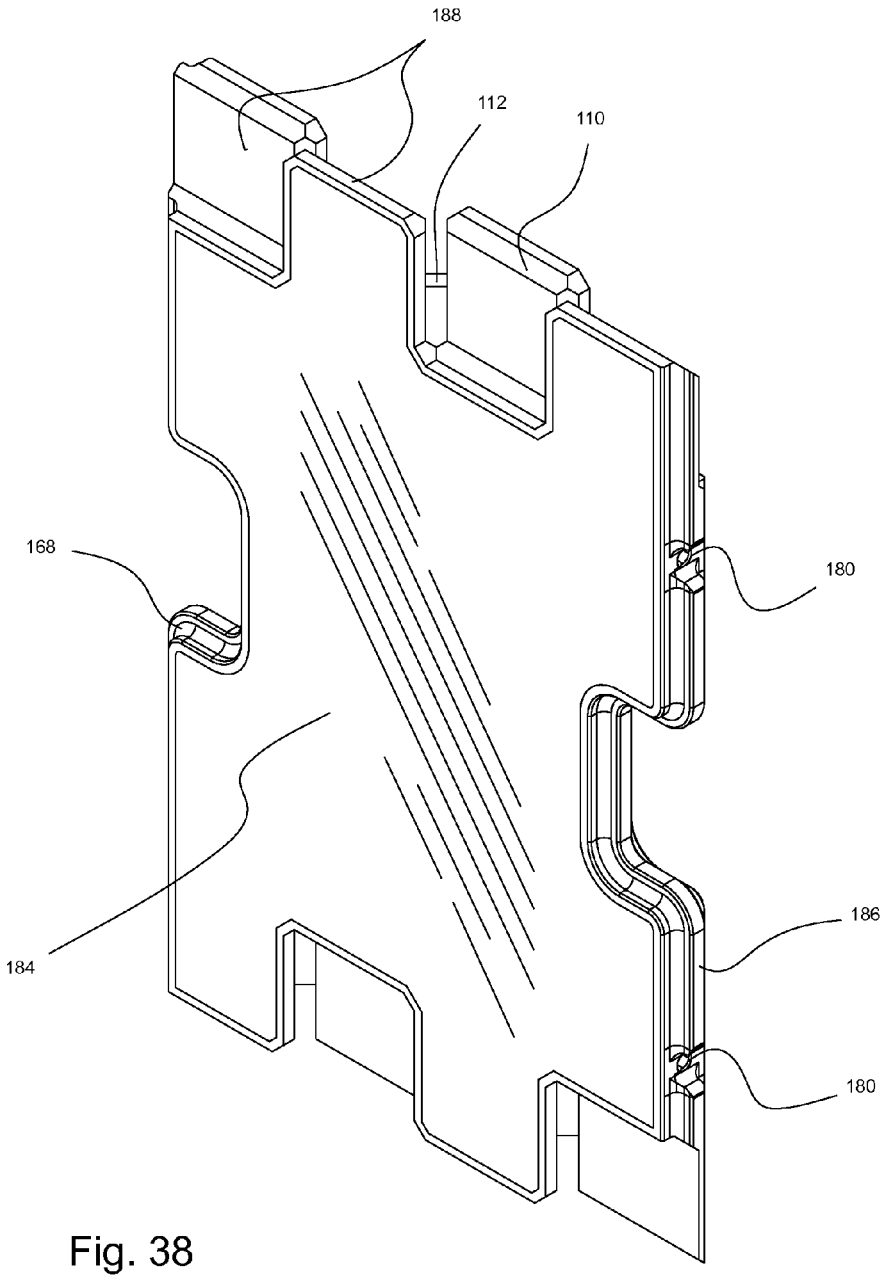
FIG. 38 is an enlarged perspective view of a complete composite middle board.

A plastic panel 184 is inserted onto an inner face of a mold cavity. The mold is then used to form a hard foam shell 176 shown enlarged in FIG. 36 without the plastic panel 184. During the molding process, the plastic panel 184 bonds to the resulting hard foam shell 176. Two hard foam shells 176 each bonded to a plastic panel 184, are then combined by frictional means made possible by there design as shown in FIG. 37. This preliminary composite part is then itself inserted into another mold where a soft foam core 186 is molded in and around specific parts of the previously mentioned preliminary composite part, predetermined by the design of the mold, forming the final composite module as shown in FIG. 38.

The primary benefit of this process is that of overcoming the limitations of insert-molding with steam-chest molding machines. The molds produced for steam-chest molding have numerous pinholes throughout every possible surface of the cavity to allow for the introduction of steam into the mold cavity during the molding process. This steam is critical to the proper forming of the part. Thus, it is not advisable to insert one or more plastic panels in such a way as to greatly reduce the quality of the molded part by blocking too many pinholes. This is why two hard foam shells 176 are first made and subsequently combined by frictional means. It is still unlikely that steam will penetrate the entire soft foam core 186 of the composite module, but this is not necessary as the hard foam shells provide the needed strength and rigidity of the composite part. All that is needed is a substantial bond between the soft foam core and the hard foam shell at the outer portions of the composite module.

This process outlined above, produces a composite module with two large opposing hard surfaces surrounded by a soft foam core. This is not otherwise achievable with a standard insert molding process.

DETAILED DESCRIPTION OF THE FOURTH EMBODIMENT

FIGS. 39-44

The fourth embodiment covers module designs that facilitate the playing of multiple concurrent beer pong game sessions.

Figure 39:
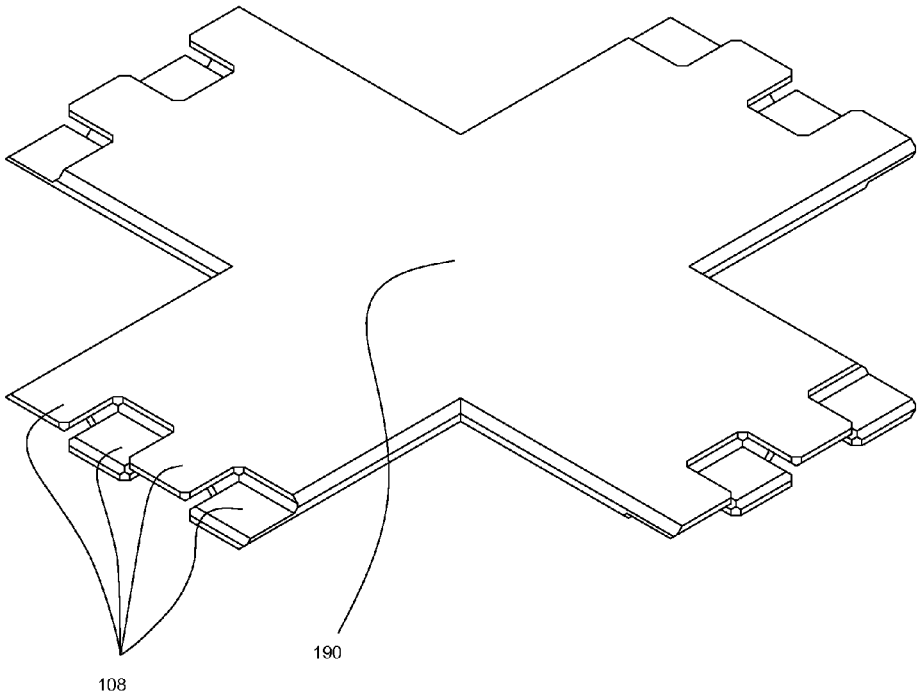
FIG. 39 is a perspective view of a cross shaped middle board in accordance with another embodiment.

FIG. 39 shows a cross shaped platform 190 having a set of diagonally opposed protrusions 108 disposed at each of the terminal edges of the platforms extremities collectively forming a cross shaped middle board 192.

Figure 40:
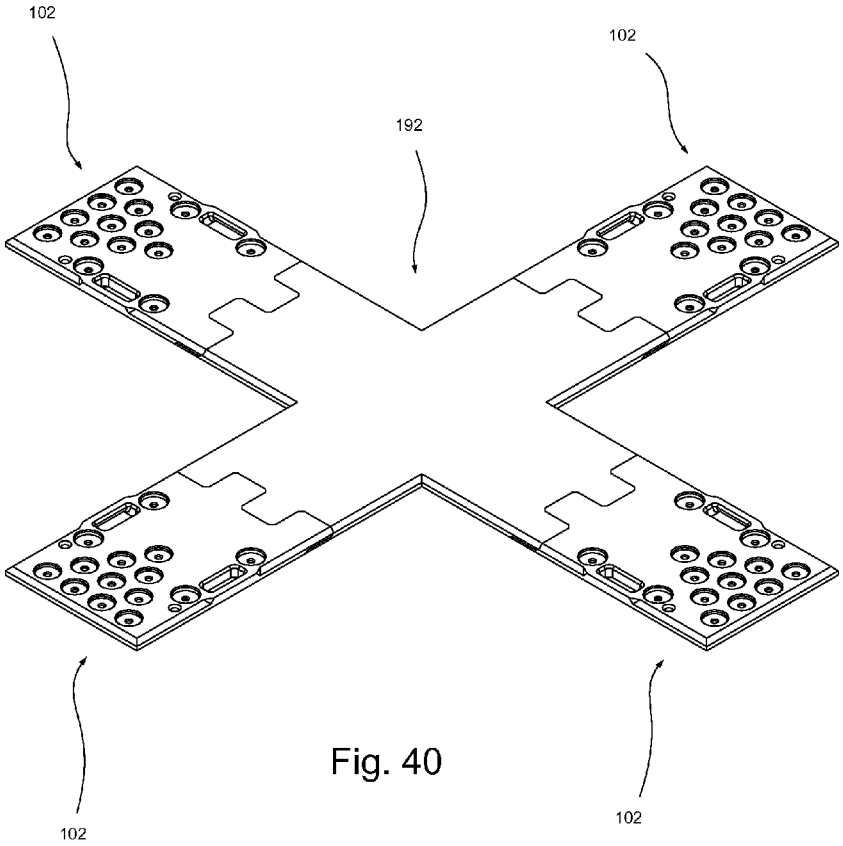
FIG. 40 is a perspective view of the cross shaped middle board and four end boards assembled as a unit.

FIG. 40 shows the cross shaped middle board 192 mated with four end boards 102.

Figure 41:
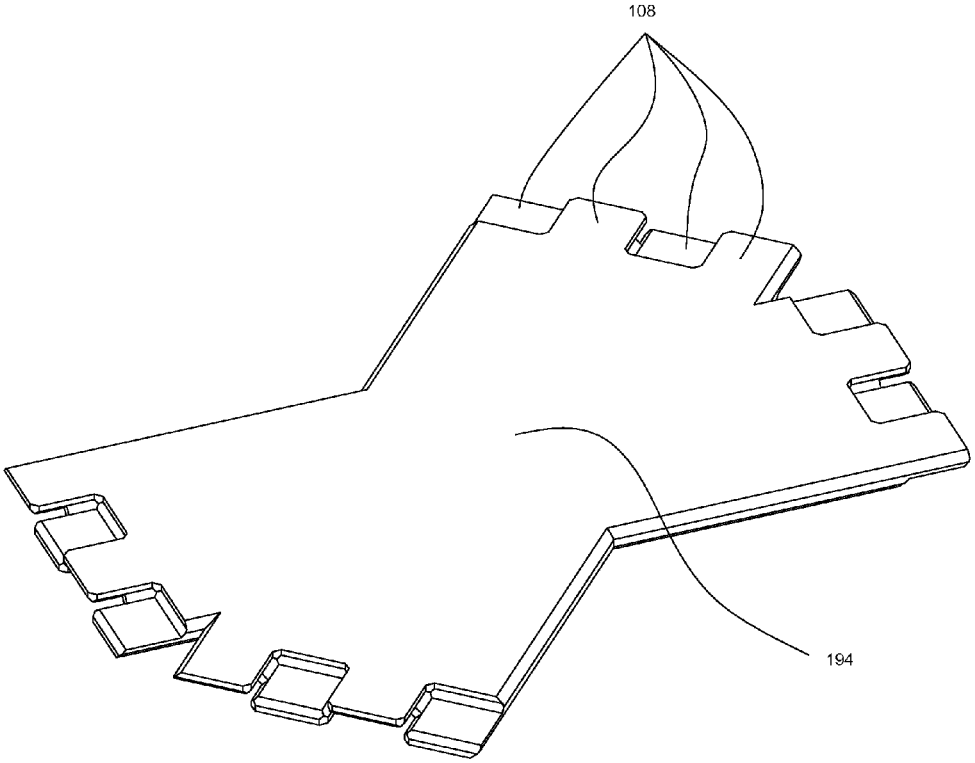
FIG. 41 is a perspective view of a bow-tie shaped middle board in accordance with another embodiment.

FIG. 41 shows a bow-tie shaped platform 194 having a set of diagonally opposed protrusions 108 disposed at each of the terminal edges of the platforms extremities collectively forming a bow-tie shaped middle board 196.

Figure 42:
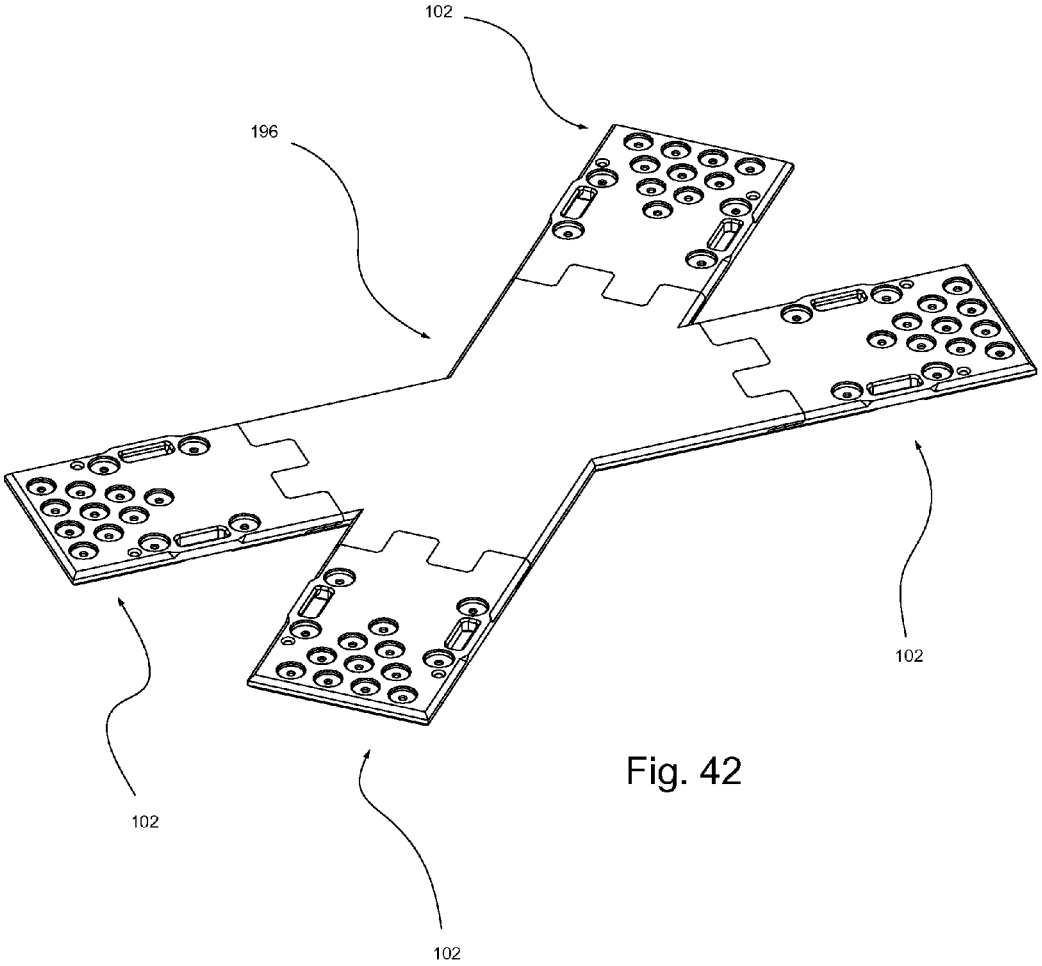
FIG. 42 is a perspective view of the bow-tie shaped middle board and four end boards assembled as a unit.

FIG. 42 shows the bow-tie shaped middle board 196 mated with four end boards 102.

Figure 43:
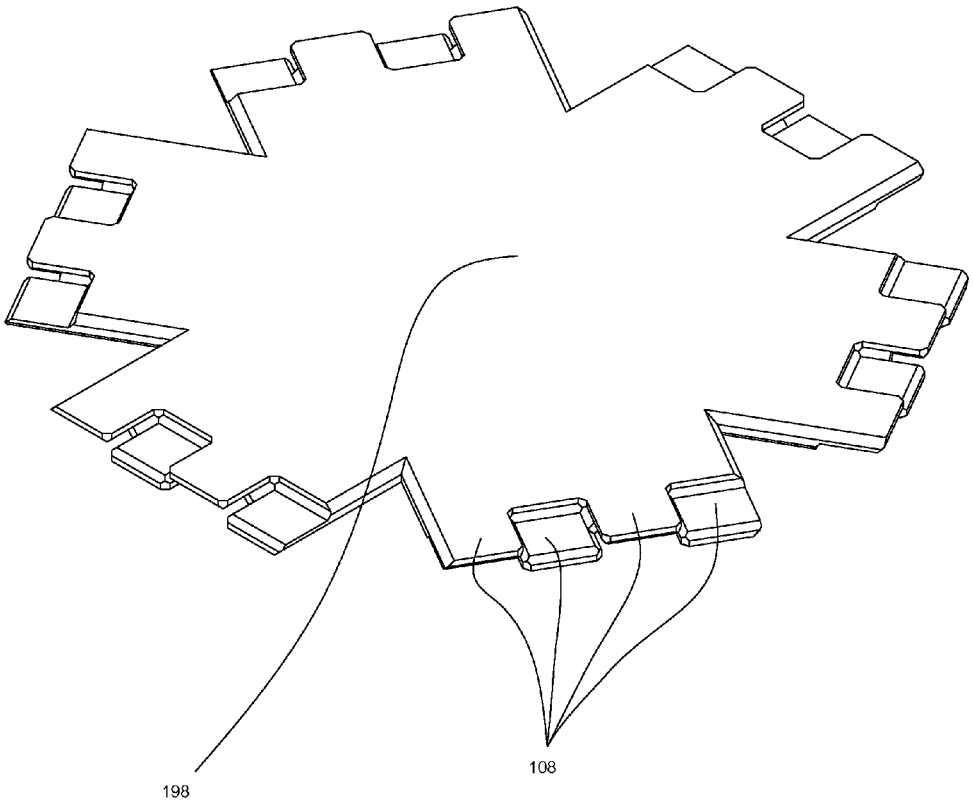
FIG. 43 is a perspective view of a snowflake shaped middle board in accordance with another embodiment.

FIG. 43 shows a snowflake shaped platform 198 having a set of diagonally opposed protrusions 108 disposed at each of the terminal edges of the platforms extremities collectively forming a snowflake shaped middle board 200.

Figure 44:
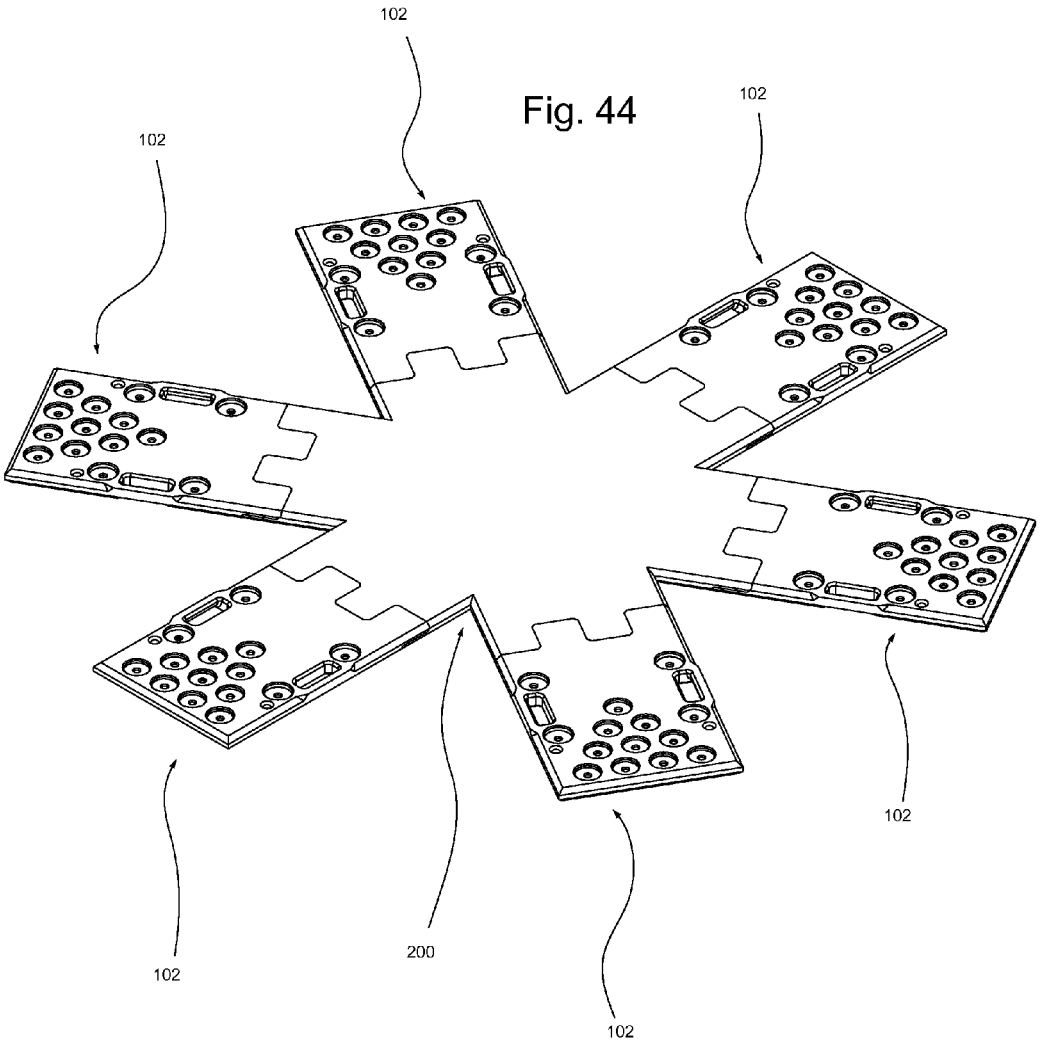
FIG. 44 is a perspective view of the snowflake shaped middle board and six end boards assembled as a unit.

FIG. 44 shows the snowflake shaped middle board 200 mated with six end boards 102.

DETAILED DESCRIPTION OF THE FIFTH EMBODIMENT

FIGS. 45-46

The fifth embodiment exemplifies the broad application of the interchangeable modules described throughout the specification. Here, a card table designed for use in the pool provides a convenient playing surface that is easily disassembled for neat storage when not in use. Other variations of this embodiment might include drink holders and handles.

Figure 45:
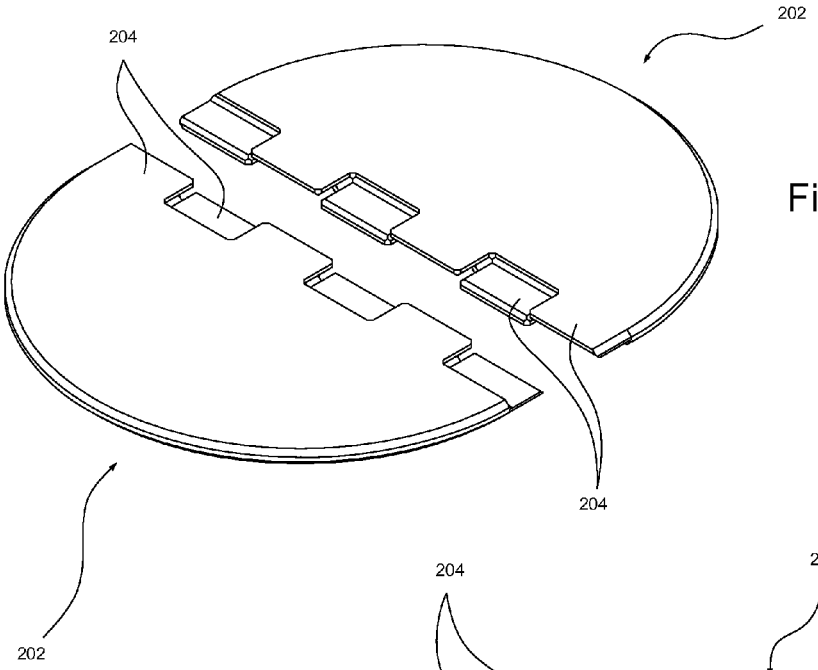
FIG. 45 is an exploded perspective view of a modular card table in accordance with another embodiment.
Figure 46:
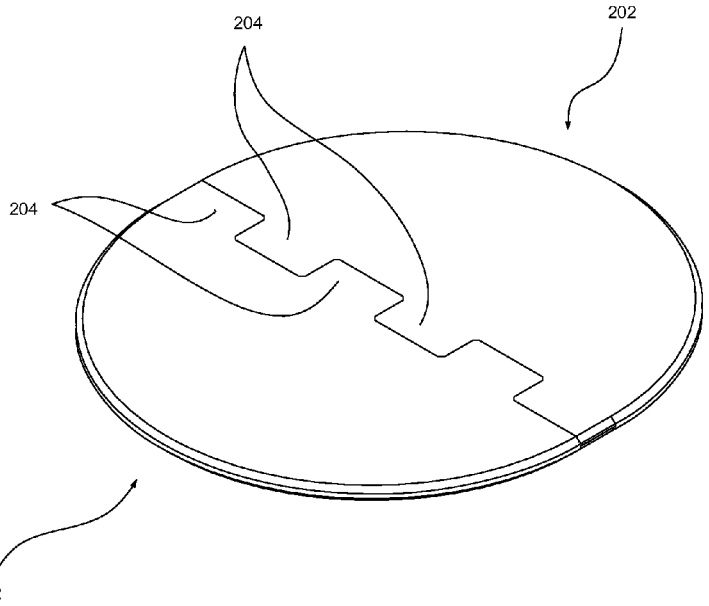
FIG. 46 is a perspective view of an assembled modular card table.

FIG. 45 shows an exploded perspective view of a modular card table comprising two modular card table halves 202 and using wide diagonally opposed protrusions 204.

FIG. 45 shows a perspective view of a modular card table comprising two modular card table halves 202.

DETAILED DESCRIPTION OF THE SIXTH EMBODIMENT

FIG. 47

Figure 47:
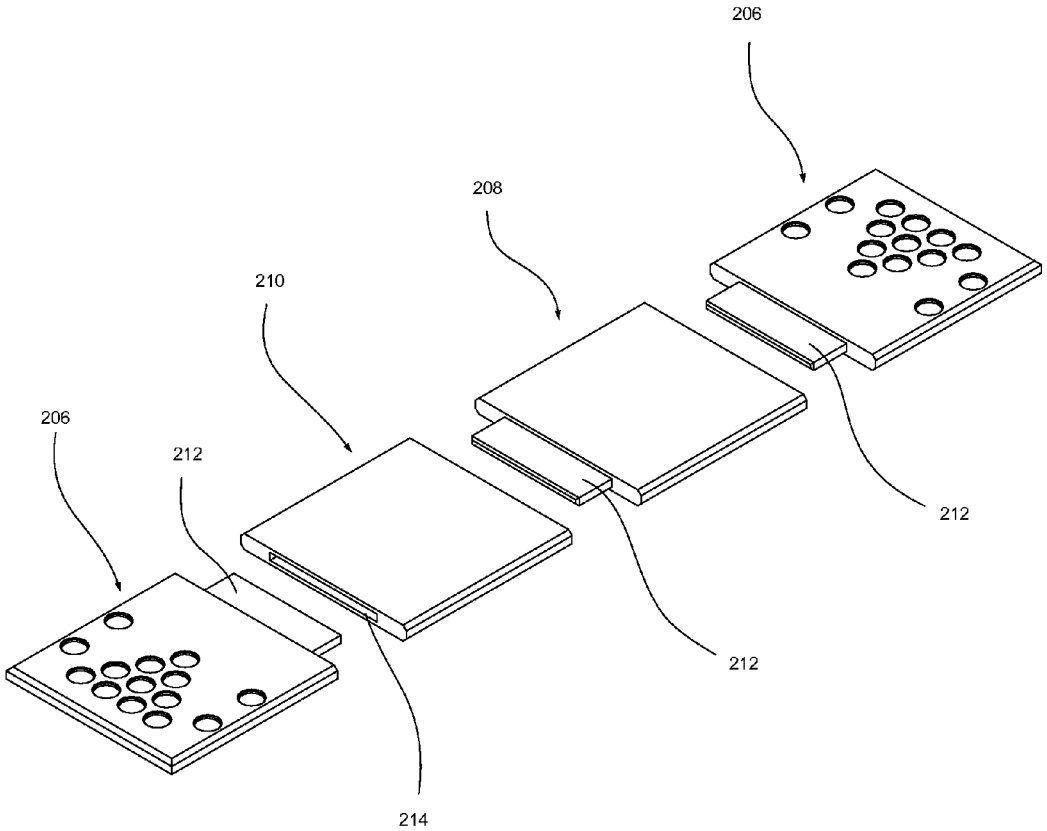
FIG. 47 is a perspective view of a modular beer pong table that employs a plug and socket system for connecting modules in accordance with another embodiment.

FIG. 47 shows an alternative means for connecting modules of a modular beer pong table. This modular beer pong table comprises two end boards with plugs 206, one middle board with plug and socket 208, and one middle board with two sockets 210. They employ a system of plugs 212 and sockets 214 in the assembly of a modular beer pong table.

DETAILED DESCRIPTION OF THE SEVENTH EMBODIMENT

FIGS. 48-57

The sixth embodiment employs the use of diagonally opposed protrusions in a toy construction set.

FIG. 48 shows a toy construction module comprising an arch platform 216 and two sets of diagonally opposed protrusions 108.

FIG. 49 shows a toy construction module comprising a four set planar platform with slit 226 and four sets of diagonally opposed protrusions 108. The slit 227 interfaces with other slits 227 of other modules to allow perpendicular arrangements of modules.

FIG. 50 shows a toy construction module comprising a three set planar platform with slit 228 and three sets of diagonally opposed protrusions 108. The slit 227 interfaces with other slits 227 of other modules to allow perpendicular arrangements of modules.

FIG. 51 shows a toy construction module comprising a three set planar platform 230 and three sets of diagonally opposed protrusions 108.

FIG. 52 shows a toy construction module comprising a castle-tower platform 232 and one set of diagonally opposed protrusions 108 having only three protrusions.

FIG. 53 shows a toy construction module comprising an obtuse angle double connector platform 218 and two sets of diagonally opposed protrusions 108.

FIG. 54 shows a toy construction module comprising a right angle double connector platform 220 and two sets of diagonally opposed protrusions 108.

FIG. 55 shows a toy construction module comprising a triple connector platform 222 and three sets of diagonally opposed protrusions 108.

FIG. 56 shows a toy construction module comprising a buttress platform 224 and one set of diagonally opposed protrusions 108.

Figure 57:
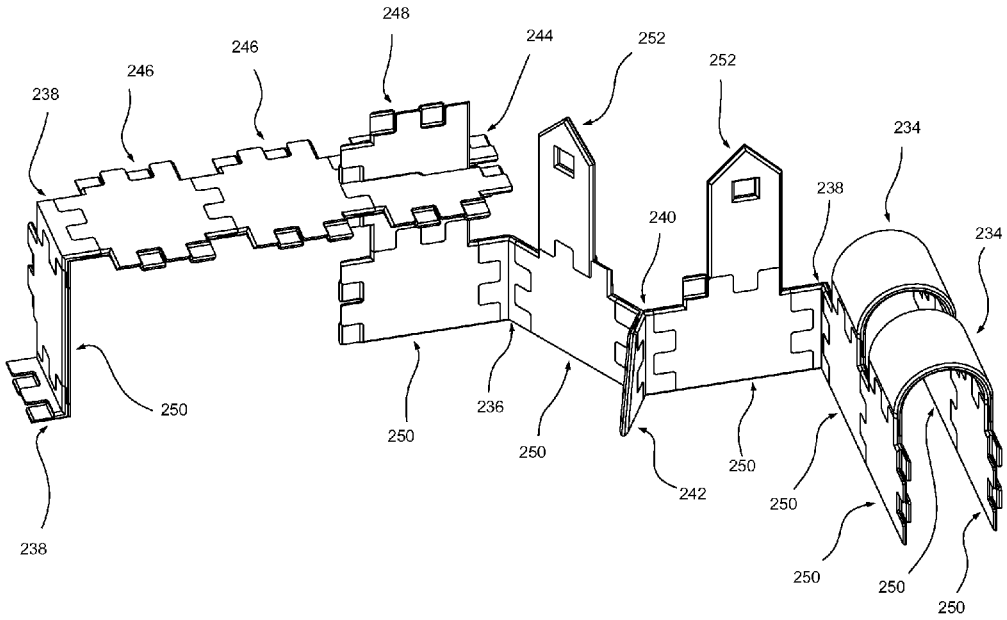
FIG. 57 is a perspective view of a play fortress made from the construction toy modules.

FIG. 57 shows a play fortress comprising ten different types of modules: an arch module 234, an obtuse angle double connector module 236, a right angle double connector module 238, a triple connector module 240, a buttress module 242, a four set planar module with slit 244, a four set planar module 246, a three set planar module with slit 248, a three set planar module 250, and a castle-tower module 252.

DETAILED DESCRIPTION OF THE EIGHTH EMBODIMENT

FIGS. 58-67

The eighth embodiment serves to highlight variations on the implementation of the set of diagonally opposed protrusions as a method for connecting modules.

Figure 58:
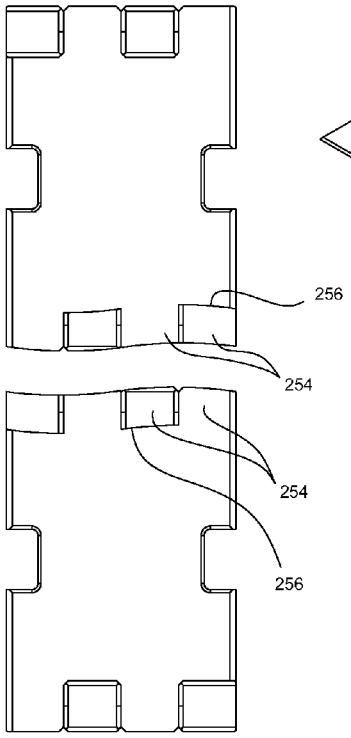
FIG. 58 is an exploded elevational view of two wave shaped middle boards in accordance with another embodiment.
Figure 59:
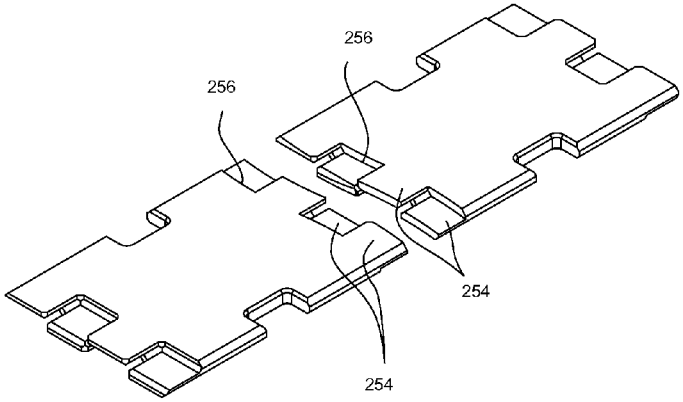
FIG. 59 is an exploded perspective view of two wave shaped middle boards.
Figure 60:
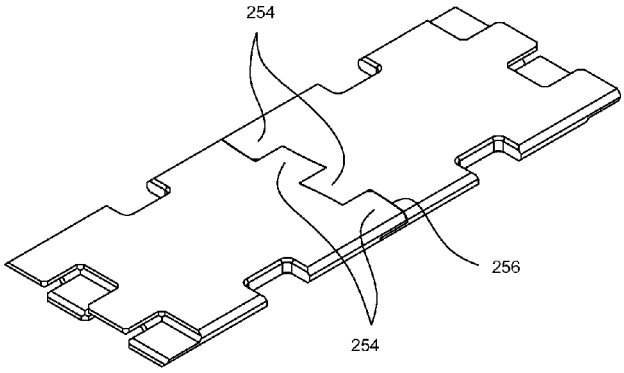
FIG. 60 is a perspective view of two wave shaped middle boards assembled as a unit.

FIGS. 58-60 show two modules comprising varied diagonally opposed protrusions 254 that protrude from a non-flat surface 256. This implementation exemplifies that it is not necessary for the protrusions of these systems to protrude normally from a surface.

Figure 61:
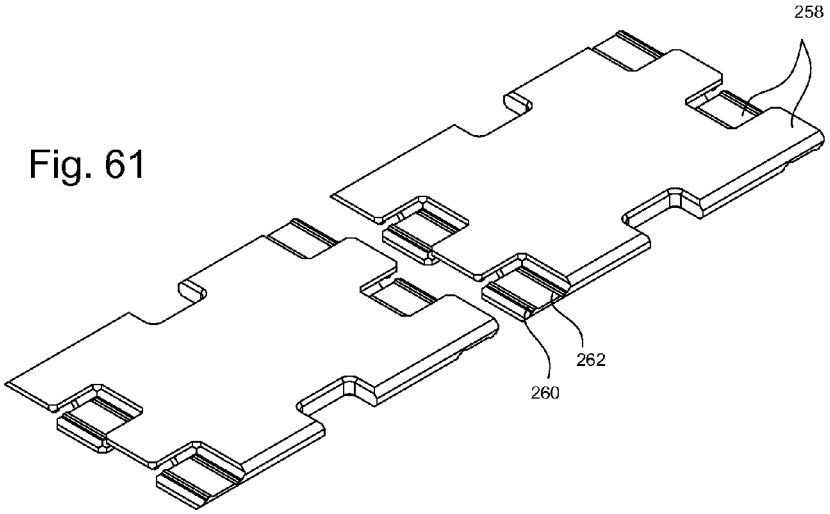
FIG. 61 is an exploded perspective view of two middle boards which employ a latching system for connecting modules, in accordance with another embodiment.
Figure 62:
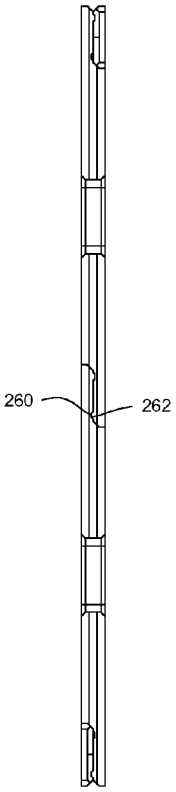
FIG. 62 is a side view of two middle boards which employ a latching system for connecting modules.
Figure 63:
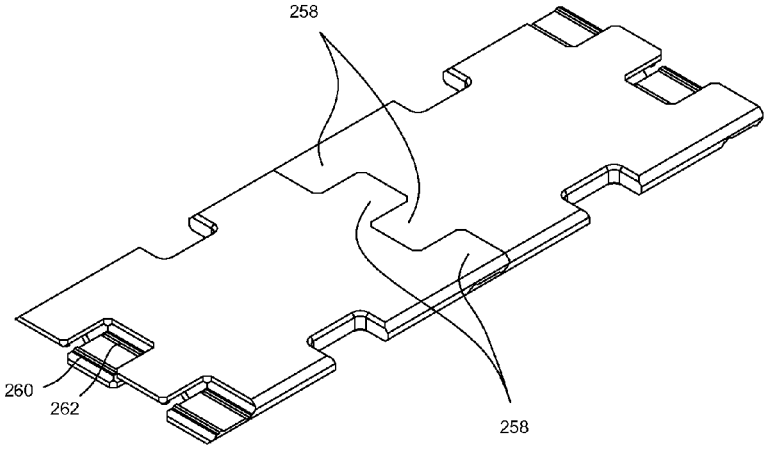
FIG. 63 is a perspective view of two middle boards which employ a latching system for connecting modules, assembled as a unit.

FIGS. 61-63 show two modules comprising diagonally opposed protrusions with a latching system 258. The protrusions further comprise a bump 260 and a trough 262 that engage each other in a latching manner so as to temporarily lock the modules together.

Figure 64:
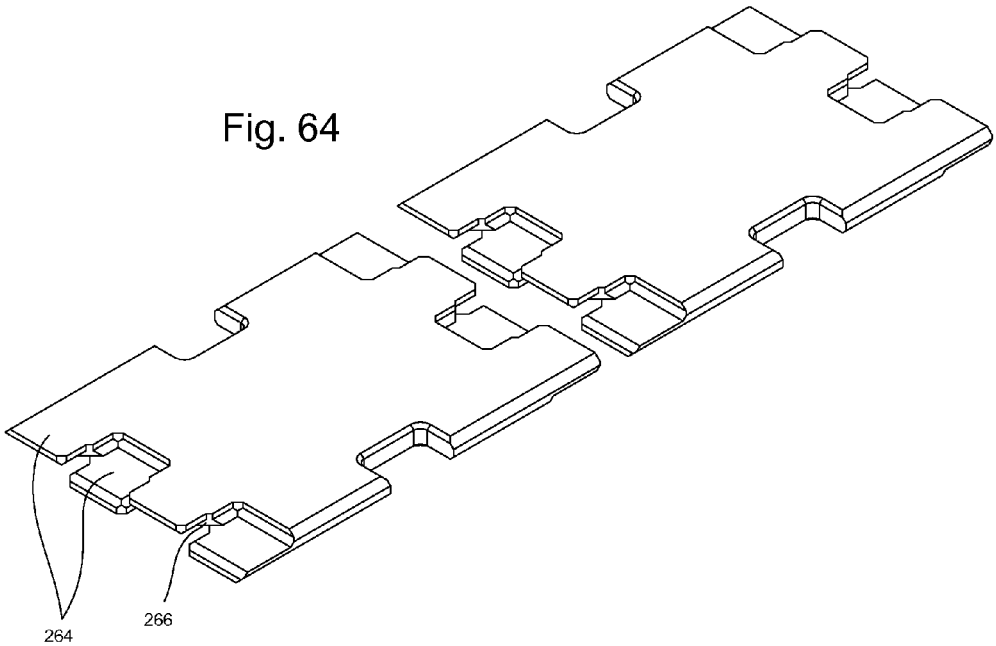
FIG. 64 is an exploded perspective view of two middle boards which have tapered protrusions, in accordance with another embodiment.
Figure 65:
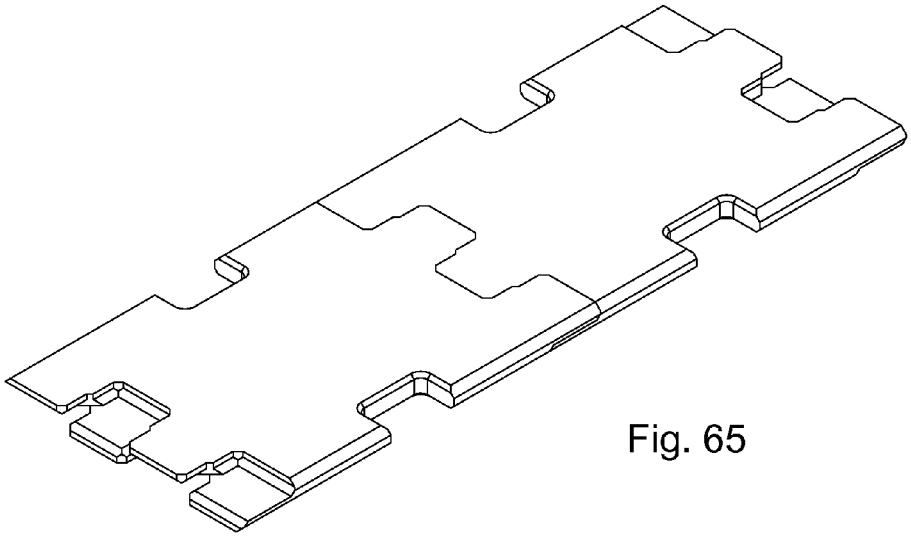
FIG. 65 is a perspective view of two middle boards which have tapered protrusions, assembled as a unit.

FIGS. 64-65 show two modules comprising diagonally opposed tapered protrusions 264 and a tapered structural webbing 266. This implementation exemplifies the fact that the protrusions and the structural webbing can assume complicated structures while still being able to perfectly mate.

FIGS. 66-67 show two modules comprising sets of diagonally opposed protrusions without structural webbing 112. This implementation exemplifies the fact the structural webbing, while highly beneficial, is not critical to the design of the modules. Designs without structural webbing 112 however will be severely deficient as compared to designs with structural webbing 112.

The invention claimed is:

1. A modular beer pong table, comprising:

a. at least two planar members wherein at least one of said planar members further comprises a triangular formation of circular depressions on a major face;

b. at least one set of diagonally opposed protrusions protruding from at least one edge of all of said planar members as a means for temporarily connecting said planar members in a manner that geometrically restricts the degree of freedom of said planar members, with respect to each other, to translation only along a single axis, and said means being equally functional when one of said planar members is flipped with respect to another of said planar members from an initially functional orientation; and c. at least one cap-like member having geometry that is complementary to the geometry of said planar members as a means for temporarily connecting said cap-like member with at least two of said planar members in a manner such that the major faces of said planar members are parallel, whereby allowing for said modular beer pong table to be assembled to a size determined by the user by connecting two or more said planar members with reasonable disregard to orientation, and whereby allowing for said modular beer pong table to be disassembled from a table-like configuration and reassembled to a compact form using said cap-like member for easy transportation and storage, and whereby allowing for a user to be assisted in placing cups in a manner consistent with the standards of beer pong gameplay, and whereby the cups are reasonably restrained during gameplay.

* * * * *